US009580220B2

(12) United States Patent
Sasaki et al.

(10) Patent No.: US 9,580,220 B2
(45) Date of Patent: Feb. 28, 2017

(54) CONTAINER AND CONTAINER WITH ENCLOSED CONTENTS

(71) Applicant: TOPPAN PRINTING CO., LTD., Tokyo (JP)

(72) Inventors: Noriyuki Sasaki, Tokyo (JP); Hideya Kondo, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 0 days.

(21) Appl. No.: 14/823,622

(22) Filed: Aug. 11, 2015

(65) Prior Publication Data

US 2015/0344189 A1 Dec. 3, 2015

Related U.S. Application Data

(63) Continuation of application No. 14/446,520, filed on Jul. 30, 2014, now Pat. No. 9,296,537, which is a (Continued)

(30) Foreign Application Priority Data

Feb. 3, 2012 (JP) ..... 2012-022409
Oct. 30, 2012 (JP) ..... 2012-238963
(Continued)

(51) Int. Cl.
*B65D 75/58* (2006.01)
*B65D 33/16* (2006.01)
(Continued)

(52) U.S. Cl.
CPC ..... *B65D 75/5811* (2013.01); *B65D 33/01* (2013.01); *B65D 33/16* (2013.01);
(Continued)

(58) Field of Classification Search
CPC ..... B65D 33/2541; B65D 33/2591; B65D 33/2508; B65D 75/5811; B65D 75/008;
(Continued)

(56) References Cited

U.S. PATENT DOCUMENTS 4,561,108 A * 12/1985 Kamp ..... B65D 33/2541 24/339
4,767,220 A * 8/1988 Kamp ..... B65D 33/2541 383/63
(Continued)

FOREIGN PATENT DOCUMENTS

EP 0 983 943 A2 3/2000
EP 2 192 048 A1 6/2010
(Continued)

OTHER PUBLICATIONS

Korean Office Action dated Mar. 15, 2016 in corresponding Korean Patent Application No. 10-2014-7024168.
(Continued)

*Primary Examiner* — Peter Helvey

(57) ABSTRACT

A container having: a bag body including an internal space to accommodate a content; an opening formed in the bag body and communicating the internal space to an outside of the container; and a fastener to open and close the opening, wherein the fastener includes a high engaging-strength portion and a low engaging-strength portion, the engaging strength of the low engaging-strength portion is less than the engaging strength of the high engaging-strength portion, the fastener includes a female track and a male track, and the low engaging-strength portion is a part of the fastener in which at least one of the female track and the male track is collapsed.

6 Claims, 17 Drawing Sheets

Related U.S. Application Data continuation of application No. PCT/JP2013/052353, filed on Feb. 1, 2013.

(30) Foreign Application Priority Data

Jan. 30, 2013 (JP) ..... 2013-016166
Jan. 30, 2013 (JP) ..... 2013-016167

(51) Int. Cl.

| | |
|---|---|
| ***B65D 51/24*** | (2006.01) |
| ***B65D 33/25*** | (2006.01) |
| ***B65D 75/00*** | (2006.01) |
| ***B65D 33/01*** | (2006.01) |
| ***B65D 81/34*** | (2006.01) |

(52) U.S. Cl.

CPC ..... *B65D 33/25* (2013.01); *B65D 33/2508* (2013.01); *B65D 51/243* (2013.01); *B65D 75/008* (2013.01); *B65D 75/5805* (2013.01); *B65D 81/3438* (2013.01); *B65D 81/3461* (2013.01)

(58) Field of Classification Search

CPC .... B65D 75/5805; B65D 33/16; B65D 33/25; B65D 33/01; B65D 51/243; B65D 25/08; B65D 81/3438; B65D 81/3461; Y10T 24/2534; Y10T 24/45168

USPC ..... 383/61.2, 61.3, 63, 64, 68

See application file for complete search history.

(56) References Cited

U.S. PATENT DOCUMENTS

| | | | | |
|---|---|---|---|---|
| 5,070,584 | A | 12/1991 | Dais et al. | |
| 5,140,727 | A | 8/1992 | Dais et al. | |
| 5,307,552 | A | 5/1994 | Dais et al. | |
| 5,478,228 | A | 12/1995 | Dais et al. | |
| 5,893,645 | A | 4/1999 | May | 383/208 |
| 5,941,643 | A | 8/1999 | Linkiewicz | 383/210 |
| 5,962,040 | A | 10/1999 | Dais et al. | |
| 6,021,557 | A | 2/2000 | Dais et al. | |
| 6,053,635 | A | 4/2000 | Anderson et al. | 383/10 |
| 6,467,956 | B1 | 10/2002 | Tilman et al. | 383/61.3 |
| 6,517,242 | B1 | 2/2003 | Buchman | 383/5 |
| 6,616,333 | B2 | 9/2003 | Kinigakis et al. | 383/64 |
| 7,322,747 | B2 | 1/2008 | Borchardt | 383/63 |
| 8,251,585 | B2 | 8/2012 | Moulin | 383/5 |
| 2003/0029884 | A1 | 2/2003 | Rau | |
| 2003/0202717 | A1 | 10/2003 | Schneider et al. | 383/5 |
| 2003/0235347 | A1 | 12/2003 | Kinigakis et al. | 383/5 |
| 2006/0210199 | A1 | 9/2006 | Ali | 383/10 |
| 2006/0215942 | A1 | 9/2006 | Steele | 383/66 |
| 2007/0041669 | A1 | 2/2007 | Rosen | |
| 2007/0071855 | A1 | 3/2007 | Kanzaki | |
| 2007/0230834 | A1 | 10/2007 | Schneider | 383/64 |
| 2008/0124006 | A1 | 5/2008 | Yamaguchi et al. | 383/9 |
| 2008/0233252 | A1 | 9/2008 | Manning et al. | 426/412 |
| 2010/0122440 | A1 | 5/2010 | Greco | |
| 2010/0158416 | A1 | 6/2010 | Ichikawa et al. | |
| 2011/0100983 | A1 | 5/2011 | Han | |
| 2011/0116730 | A1 | 5/2011 | Kawakami et al. | 383/41 |
| 2012/0106874 | A1* | 5/2012 | Pawloski | B65D 33/255 383/63 |
| 2012/0106875 | A1* | 5/2012 | Pawloski | B65D 33/255 383/64 |
| 2012/0106876 | A1* | 5/2012 | Pawloski | B65D 33/255 383/97 |
| 2012/0213454 | A1 | 8/2012 | Price et al. | |
| 2012/0213455 | A1* | 8/2012 | Price | B65D 33/2558 383/100 |

FOREIGN PATENT DOCUMENTS

| | | |
|---|---|---|
| EP | 2 810 890 A1 | 12/2014 |
| GB | 2 458 645 A | 9/2009 |
| JP | 60-217955 | 10/1985 |
| JP | 3-289451 | 12/1991 |
| JP | 5-58609 | 8/1993 |
| JP | 8-58811 | 3/1996 |
| JP | 8-198280 | 8/1996 |
| JP | 9-169349 | 6/1997 |
| JP | 11-157550 | 6/1999 |
| JP | 2002-225955 | 8/2002 |
| JP | 2003-11984 | 1/2003 |
| JP | 2003-40356 | 2/2003 |
| JP | 2003-81284 | 3/2003 |
| JP | 2004-256157 | 9/2004 |
| JP | 2005-14953 | 1/2005 |
| JP | 2005-178903 | 7/2005 |
| JP | 2008-222295 | 9/2006 |
| JP | 2006-282189 | 10/2006 |
| JP | 2007-22572 | 2/2007 |
| JP | 2007-507399 | 3/2007 |
| JP | 2007-106457 | 4/2007 |
| JP | 2008-114546 | 5/2008 |
| JP | 2008-127021 | 6/2008 |
| JP | 2008-285190 | 11/2008 |
| JP | 2009-166846 | 7/2009 |
| JP | 2009-166847 | 7/2009 |
| JP | 2010-95277 | 4/2010 |
| JP | 2010-95286 | 4/2010 |
| JP | 2010-120190 | 6/2010 |
| JP | 2011-1099 | 1/2011 |
| JP | 2011-230775 | 11/2011 |
| WO | WO 94/26605 | 11/1994 |
| WO | WO 2006/008398 A1 | 1/2006 |
| WO | WO 2007/108251 A1 | 9/2007 |

OTHER PUBLICATIONS

Chinese Office Action dated Dec. 3, 2015 in corresponding Chinese Patent Application No. 201380007357.6.

Partial Supplemental European Search Report issued Aug. 25, 2015 in European Patent Application No. 13743806.5.

Japanese Office Action dated Nov. 24, 2015 in corresponding Japanese Patent Application No. 2015-067160.

International Search Report mailed Mar. 12, 2013, in corresponding International Patent Application No. PCT/JP2013/052353.

Japanese Office Action dated Sep. 2, 2014 in corresponding Japanese Patent Application No. 2013-016166.

Japanese Office Action dated Sep. 2, 2014 in corresponding Japanese Patent Application No. 2013-016167.

PCT International Preliminary Report on Patentability issued Aug. 5, 2014 in corresponding International Patent Application No. PCT/JP2013/052353.

Japanese Office Action dated Jan. 27, 2015 in corresponding Japanese Patent Application No. 2013-016167.

Japanese Office Action dated Jul. 14, 2015 in Japanese Patent Application No. 2015-067161.

Japanese Office Action dated Jul. 14, 2015 in Japanese Patent Application No. 2015-067160.

Office Action issued from the United States Patent and Trademark Office on May 6, 2015 in the related U.S. Appl. No. 14/446,520.

U.S. Appl. No. 14/446,520, filed Jul. 30, 2014, Noriyuki Sasaki et al., Toppan Printing Co., Ltd.

U.S. Appl. No. 14/823,434, filed Aug. 11, 2015, Noriyuki Sasaki et al., Toppan Printing Co., Ltd.

U.S. Appl. No. 14/823,538, filed Aug. 11, 2015, Noriyuki Sasaki et al., Toppan Printing Co., Ltd.

Japanese Report of Reconsideration by Examiner before Appeal dated May 17, 2016 in corresponding Japanese Patent Application No. 2015-067161.

Extended European Search Report dated Jun. 24, 2016 in corresponding European Patent Application No. 16163140.3.

(56) References Cited

OTHER PUBLICATIONS

Japanese Office Action dated Dec. 20, 2016 in corresponding Japanese Patent Application No. 2016-029621.

* cited by examiner

Fig.26

| Engaging strength of low-engaging strength portion (N/20mm) | Strength ratio (%) | Fastener opening mode when content sealing pouch is heated in microwave oven |
|---|---|---|
| 38 | 100 | X:Fastener opened with large sound |
| 36 | 95 | X:Fastener opened with large sound |
| 34 | 90 | Δ:Sound at opening of fastener became slightly smaller |
| 30 | 80 | Δ:Sound at opening of fastener became slightly smaller |
| 27 | 70 | Δ:Sound at opening of fastener became slightly smaller |
| 19 | 50 | O:Sound at opening of fastener became smaller |
| 11 | 30 | O:Sound at opening of fastener became smaller |
| 0 | 0 | O:Sound at opening of fastener became smaller |

Fig.27

| Low-engaging strength portion length (mm) | Strength portion length ratio (%) | Fastener opening mode when content sealing pouch is heated in microwave oven |
|---|---|---|
| 0 | 0 | X:Zipper tape opened with large sound |
| 7.5 | 5 | Δ:Sound at opening of fastener became slightly smaller |
| 15 | 10 | O:Sound at opening of fastener became smaller |
| 30 | 20 | O:Sound at opening of fastener became smaller |
| 75 | 50 | O:Sound at opening of fastener became smaller |
| 105 | 70 | O:Sound at opening of fastener became smaller |
| 120 | 80 | O:Sound at opening of fastener became smaller |

CONTAINER AND CONTAINER WITH ENCLOSED CONTENTS

CROSS-REFERENCE TO RELATED APPLICATIONS

This application is a U.S. continuation application filed under 37 C.F.R. 1.53(b) claiming priority benefit of U.S. application Ser. No. 14/446,520, filed Jul. 30, 2014, pending, which is a continuation, filed under 35 U.S.C. §111(a), of International Application PCT/JP2013/052353, filed Feb. 1, 2013, which claims foreign priority benefit to Japanese Patent Application No. 2012-022409, filed on Feb. 3, 2012, Japanese Patent Application No. 2012-238963, filed on Oct. 30, 2012, Japanese Patent Application No. 2013-016166, filed on Jan. 30, 2013, and Japanese Patent Application 2013-016167, filed Jan. 30, 2013, all of which are incorporated herein by reference.

BACKGROUND

1. Field

The present invention relates to a pouch including a bag, which has an internal space for accommodating contents and a first opening and is adapted to place the contents into the internal space through the first opening, and a fastener for opening and closing the first opening. The present invention also relates to a content sealing pouch.

2. Description of Related Art

Japanese Laid-Open Patent Publication No. 2009-166847 (JP2009-166847) discloses an example of a pouch and a content sealing pouch.

The pouch in JP2009-166847 has a package (bag) having an opening and a zipper member (fastener) for opening and closing the opening. The content sealing pouch in JP2009-166847 has a pouch and food material (content).

The content sealing pouch is manufactured by the following manufacturing method. First, food material is introduced into an internal space through the opening of the pouch by using a nozzle. Next, the zipper member is closed by using a zipper closing device. Then, the opening of the package is sealed with a sealing device. This seals the internal space of the package with enclosed food material. That is, manufacturing of the content sealing pouch is completed.

In the above described manufacturing method, when the food material is introduced into the internal space of the package, the food material can adhere to the zipper member. Although the pouch in Patent Document 1 is taken as an example, any pouch having a bag and a fastener can have the same problem.

Accordingly, an objective of the present invention is to provide a pouch and a content sealing pouch that are capable of suppressing adhesion of contents to a fastener.

SUMMARY

To achieve the foregoing objective and in accordance with one aspect of the present invention, a pouch that includes a bag and a fastener is provided. The bag includes an internal space for accommodating a content and a first opening. The bag is adapted to place the content in the internal space through the first opening. The fastener is used for opening and closing the first opening. The bag further includes a second opening and is adapted to place the content in the internal space through the second opening.

Since the bag has a second opening, in the manufacturing process of the content sealing pouch, the contents can be placed into the internal space of the bag through the second opening. For this reason, in the manufacturing process of the content sealing pouch, the possibility that the contents adhere to the fastener is reduced.

In accordance with another aspect of the present invention, a content sealing pouch is provided that includes the above described pouch in which the second opening is sealed and a content accommodated in the bag of the pouch.

BRIEF DESCRIPTION OF THE DRAWINGS

FIG. 26 is a table showing experiment results that demonstrate the opening condition of a fastener with varying engaging strengths of the low engaging-strength portion; and FIG. 27 is a table showing experiment results that demonstrate the opening condition of the fastener with varying lengths of the low engaging-strength portion.

DESCRIPTION OF EMBODIMENTS

First Embodiment

Figure 1:
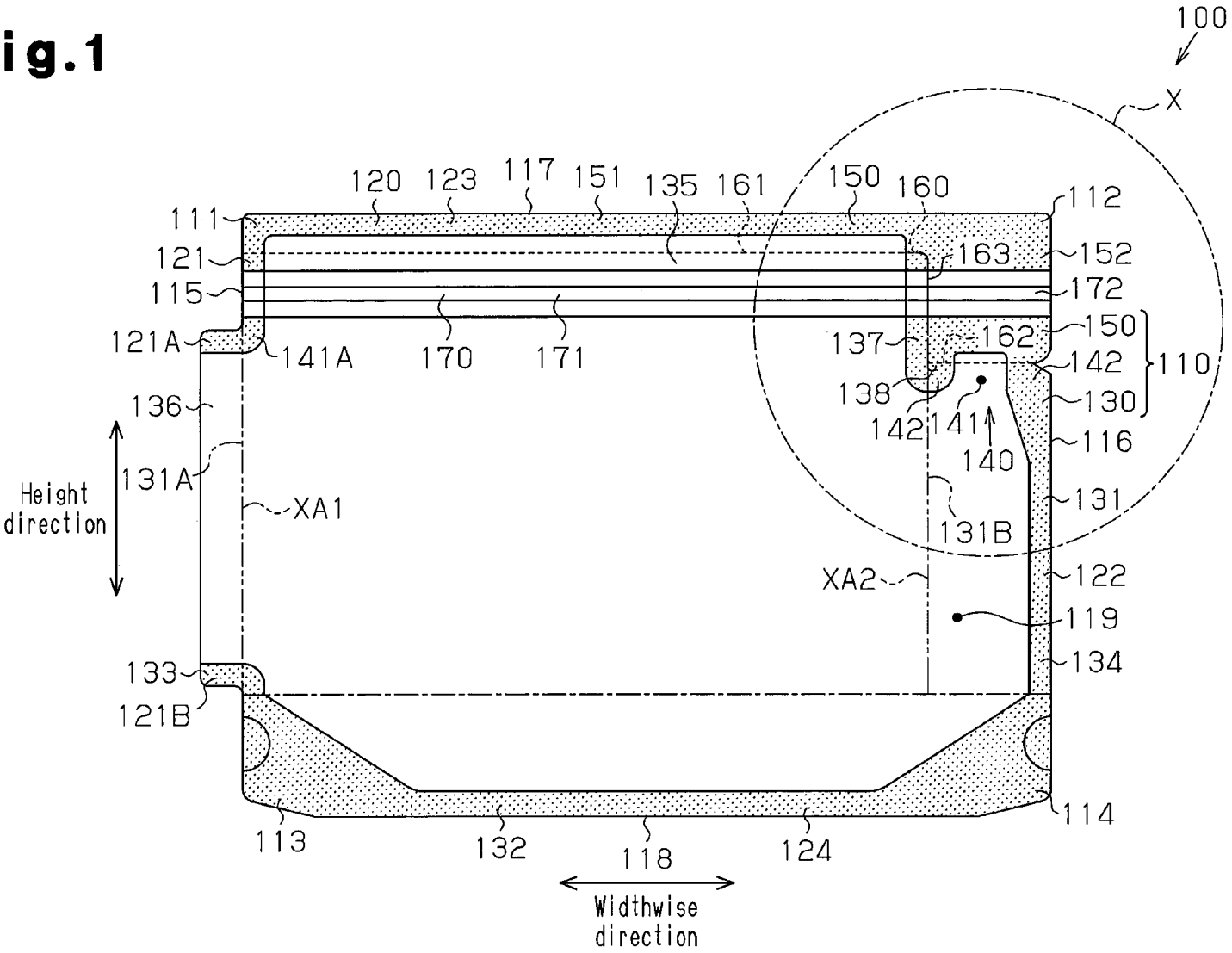
FIG. 1 is a front view of a pouch according to a first embodiment.

The configuration of a pouch 100 will be described with reference to FIG. 1. The dotted regions shown in FIGS. 1 to 6 each represent a sealing portion 120 of the pouch 100. In the following description, the widthwise direction of the pouch 100 is orthogonal to the height direction of the pouch 100 in a front view of the pouch 100.

The pouch 100 has a form of a standing pouch. The pouch 100 includes a bag 110 and a fastener 170. The entire edge of the pouch 100 except for a part in which a second opening 136 is formed is sealed.

The bag 110 includes a first bag portion 130, a second bag portion 150, the sealing portion 120, and a guide line 160. The bag 110 is formed of a laminated sheet. The laminated sheet has an outermost layer, an intermediate layer, and an innermost layer. The outermost layer is a layer located on the outermost side in the bag 110 and is formed of a polyethylene terephthalate layer. The innermost layer is a layer located on the innermost side in the bag 110, and is formed of a non-oriented polypropylene layer. The intermediate layer includes a print layer, a first adhesive layer, an oriented nylon layer, and a second adhesive layer. The print layer is formed inside the outermost layer. The first adhesive layer is formed inside the print layer. The oriented nylon layer is formed inside the first adhesive layer. The second adhesive layer is formed inside the oriented nylon layer. The innermost layer is formed inside the second adhesive layer. The print layer has pictures, item descriptions and the like on its outer surface.

The bag 110 includes a first corner 111, a second corner 112, a third corner 113, a fourth corner 114, a first side edge 115, a second side edge 116, an upper edge 117, a lower edge 118, and an internal space 119.

The first side edge 115 forms an edge from the first corner 111 to the third corner 113 in the bag 110. The second side edge 116 forms an edge from the second corner 112 to the fourth corner 114 in the bag 110. The upper edge 117 forms an edge from the first corner 111 to the second corner 112 in the bag 110. The lower edge 118 forms an edge from the third corner 113 to the fourth corner 114 in the bag 110.

The first side edge 115 is continuous with the upper edge 117 at the first corner 111. The first side edge 115 is continuous with the lower edge 118 at the third corner 113. The second side edge 116 is continuous with the upper edge 117 at the second corner 112. The second side edge 116 is continuous with the lower edge 118 at the fourth corner 114.

The first bag portion 130 includes a bag body 131, a bottom gusset 132, a first protruding portion 133, and a second protruding portion 134.

The bag body 131 includes a first lateral portion 131A, a second lateral portion 131B, a first opening 135, the second opening 136, a bag predetermined portion 137, and a cutting restraining portion 138.

The first lateral portion 131A corresponds to a region in the bag body 131 that is closer to the internal space 119 than a long dashed double-short dashed line XA1 in the drawing.

The second lateral portion 131B corresponds to a region in the bag body 131 that is closer to the internal space 119 than a long dashed double-short dashed line XA2 in the drawing.

The first opening 135 is located on the upper edge of the first bag portion 130 including the fastener 170.

The first opening 135 functions to accommodate contents in the internal space 119 in the state where the bag 110 is divided into the first bag portion 130 and the second bag portion 150. The first opening 135 is formed to be continuous with the vapor passage portion 140.

The second opening 136 is formed in a protruding portion extending outward in the widthwise direction from the first lateral portion 131A. The second opening 136 functions to accommodate contents in the internal space 119.

The bottom gusset 132 supports the bag body 131. A long dashed short dashed line in the drawing represents the boundary between the bottom gusset 132 and the bag body 131.

The first protruding portion 133 protrudes outward in the widthwise direction from the first lateral portion 131A. The first protruding portion 133 includes the second opening 136.

The second protruding portion 134 protrudes outward in the widthwise direction from the second lateral portion 131B. The second protruding portion 134 includes the vapor passage portion 140.

The vapor passage portion 140 allows the internal space 119 to communicate with the outside. The vapor passage portion 140 includes an unsealed part in a portion of the second protruding portion 134. The vapor passage portion 140 has a vapor passage 141 and a passage sealing portion 142. The vapor passage portion 140 is formed by sealing the second protruding portion 134 except for regions corresponding to the vapor passage 141 and the internal space 119.

The bag predetermined portion 137 is located in the vicinity of the vapor passage portion 140 and on the side of the fastener 170 that corresponds to the internal space 119.

The cutting restraining portion 138 is configured to restrain the bag predetermined portion 137 from being cut up to the internal space 119. The cutting restraining portion 138 is formed in the passage sealing portion 142 on the side of the second lateral portion 131B.

The second bag portion 150 includes an opening sealing portion 151 and a vapor passage sealing portion 152.

The opening sealing portion 151 is formed in the upper edge 117. The opening sealing portion 151 closes the first opening 135. The opening sealing portion 151 is formed to be continuous with the vapor passage sealing portion 152. The vapor passage sealing portion 152 closes the vapor passage portion 140. The vapor passage sealing portion 152 forms a portion of the second protruding portion 134.

The sealing portion 120 is formed by thermal welding. The sealing portion 120 includes a first lateral sealing portion 121, a second lateral sealing portion 122, an upper sealing portion 123, and a lower sealing portion 124.

The first lateral sealing portion 121 seals a predetermined region including the first side edge 115 in the bag 110. The first lateral sealing portion 121 includes a lateral sealing upper part 121A and a lateral sealing lower part 121B. The lateral sealing upper part 121A and the lateral sealing lower part 121B are separated from each other by the second opening 136.

The lateral sealing upper part 121A seals the region from the first corner 111 to the second opening 136 in the bag 110.

The lateral sealing lower part 121B seals the boundary between the bag body 131 and the bottom gusset 132 in the second opening 136.

The second lateral sealing portion 122 seals a predetermined region including the second side edge 116 in the bag 110. The upper sealing portion 123 seals a predetermined region including the upper edge 117. The upper sealing portion 123 includes the opening sealing portion 151. The lower sealing portion 124 seals a predetermined region including the lower edge 118.

The guide line 160 is formed to separate the first bag portion 130 from the second bag portion 150 in the bag 110.

The fastener 170 opens and closes the first opening 135. The fastener 170 includes an opening fastener portion 171 and a vapor passage fastener portion 172. The opening fastener portion 171 is formed to bridge the first opening 135 and the vapor passage sealing portion 152. The vapor passage fastener portion 172 is formed on the vapor passage sealing portion 152.

Figure 2:
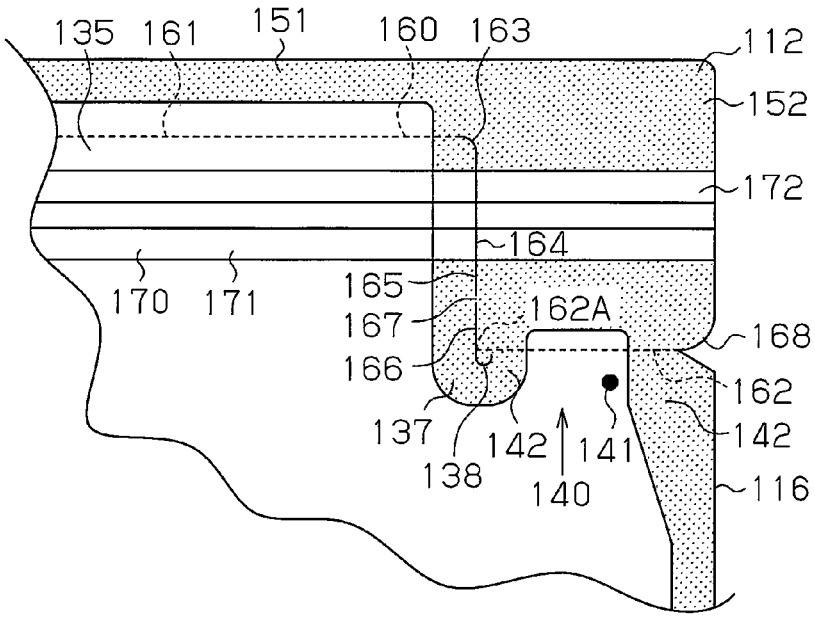
FIG. 2 is an enlarged view of part X of the pouch of FIG. 1.

With reference to FIG. 2, the detailed configuration of the guide line 160 will be described.

The guide line 160 includes an opening guide line 161, a vapor passage guide line 162, a cutting portion 163, and a notch 168.

The opening guide line 161 separates the opening sealing portion 151 from the first opening 135. The opening sealing portion 151 can be separated from the first opening 135 along the opening guide line 161. The opening guide line 161 is formed by half-cutting a film constituting the bag 110 with a laser.

The vapor passage guide line 162 separates the vapor passage sealing portion 152 from the vapor passage portion 140. The vapor passage sealing portion 152 can be separated from the vapor passage portion 140 along the vapor passage guide line 162. The vapor passage guide line 162 is formed by half-cutting a film constituting the bag 110 with a laser.

The cutting portion 163 includes an intermediate cutting portion 164, a first predetermined cutting portion 165, a second predetermined cutting portion 166, and a separating portion 167. The cutting portion 163 is formed at a position corresponding to an end 162A of the vapor passage guide line 162. The cutting portion 163 is formed to be continuous with the opening guide line 161 and the vapor passage guide line 162.

The intermediate cutting portion 164 cuts the fastener 170. The first predetermined cutting portion 165 is continuous with the intermediate cutting portion 164. The first predetermined cutting portion 165 cuts the bag predetermined portion 137. The second predetermined cutting portion 166 is located at an end of the first predetermined cutting portion 165 near the internal space 119. The cutting restraining portion 138 is formed at an end of the second predetermined cutting portion 166 near the internal space 119. The cutting restraining portion 138 is configured such that the second predetermined cutting portion 166 is curved in the direction opposite to the internal space 119.

The separating portion 167 separates the first predetermined cutting portion 165 from the second predetermined cutting portion 166.

The notch 168 is located at the point of contact between the vapor passage guide line 162 and the second side edge 116. The notch 168 functions as a starting point where the vapor passage sealing portion 152 is separated from the vapor passage portion 140 along the vapor passage guide line 162.

Figure 3:
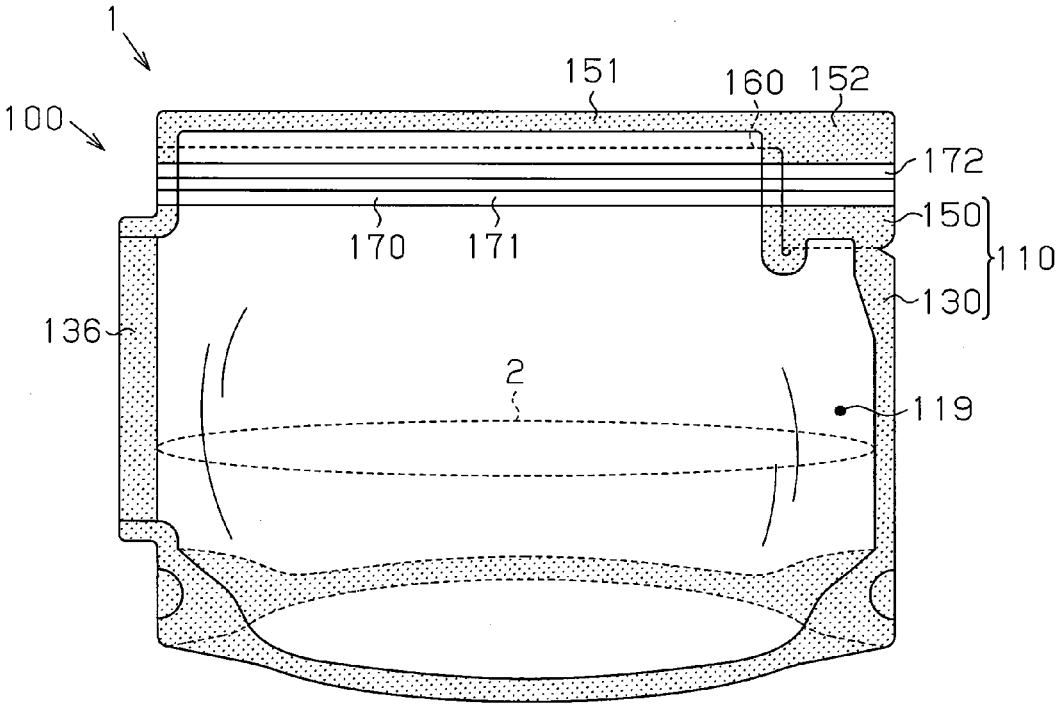
FIG. 3 is a diagram of the pouch of FIG. 1 into which content is sealed.

With reference to FIG. 3, the configuration of a content sealing pouch 1 will be described.

The content sealing pouch 1 includes content 2 and the pouch 100. In the pouch 100 of the content sealing pouch 1, the second opening 136 is sealed in the state where the content 2 is accommodated in the internal space 119. The content 2 is liquid condiment.

Figure 4C:
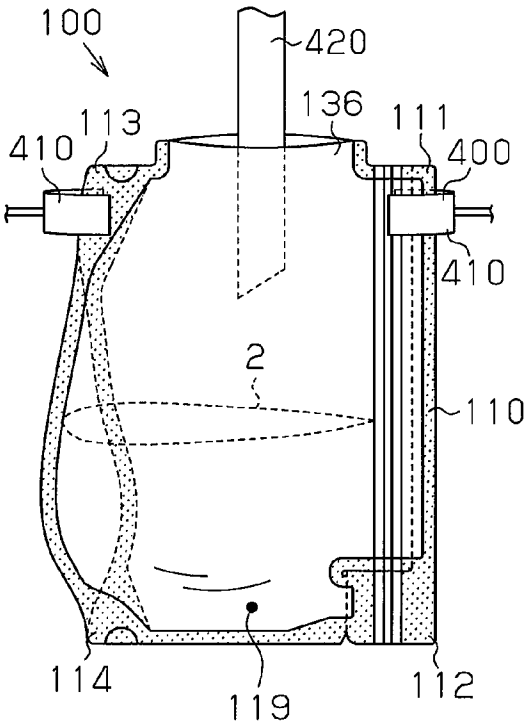
FIGS. 4(*a*)-4(*c*) are diagrams showing a manufacturing process of the content sealing pouch of FIG. 3, where FIG. 4(*a*) is a front view of a bag with a second opening being opened, FIG. 4(*b*) is a front view of the bag into which a nozzle of a filler is inserted through the second opening, and FIG. 4(*c*) is a front view of the bag with contents in an internal space.
Figure 4B:
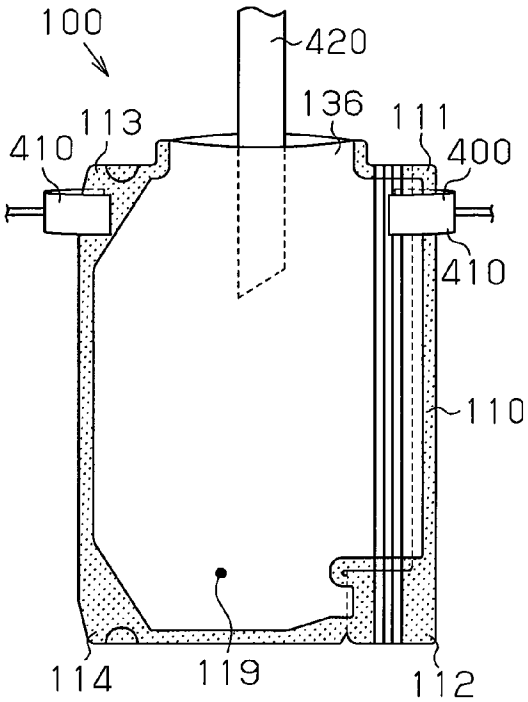
Figure 4A:
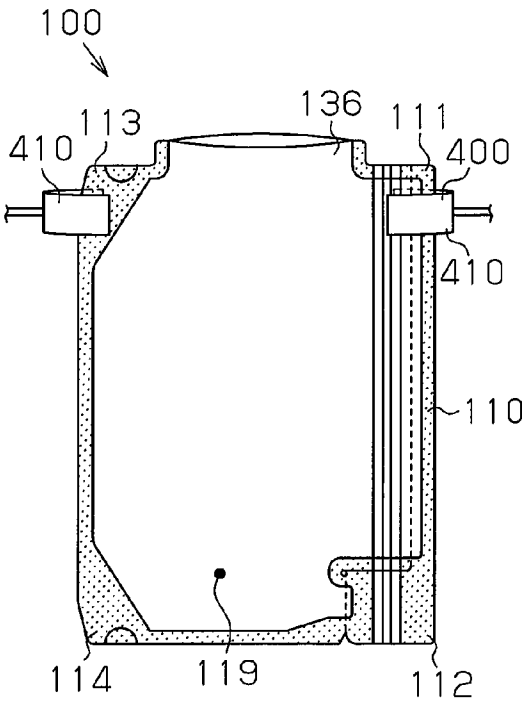

With reference to FIGS. 4(*a*)-(*c*) and FIGS. 5(*a*)-(*c*), a manufacturing process of the content sealing pouch 1 will be described.

Figure 5C:
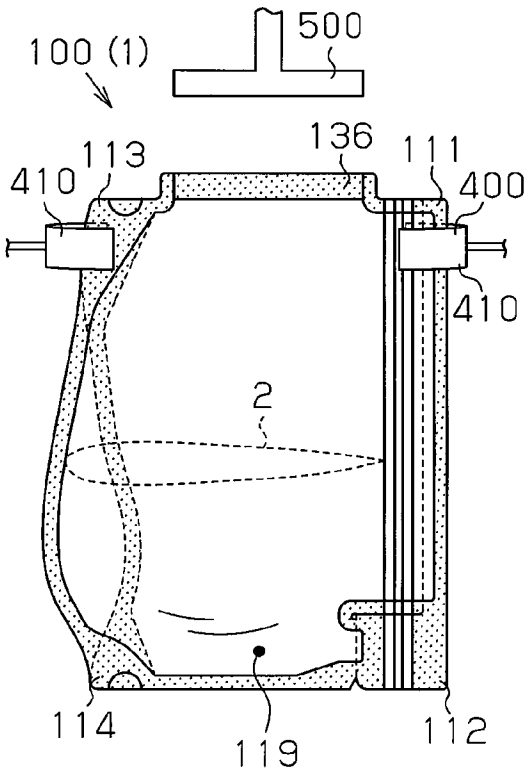
FIGS. 5(*a*)-5(*c*) are diagrams showing a manufacturing process of the content sealing pouch of FIG. 3, where FIG. 5(*a*) is a front view of a bag before sealing of the second opening, FIG. 5(*b*) is a front view of the bag during sealing of the second opening, and FIG. 5(*c*) is a front view of the bag after sealing of the second opening.
Figure 5B:
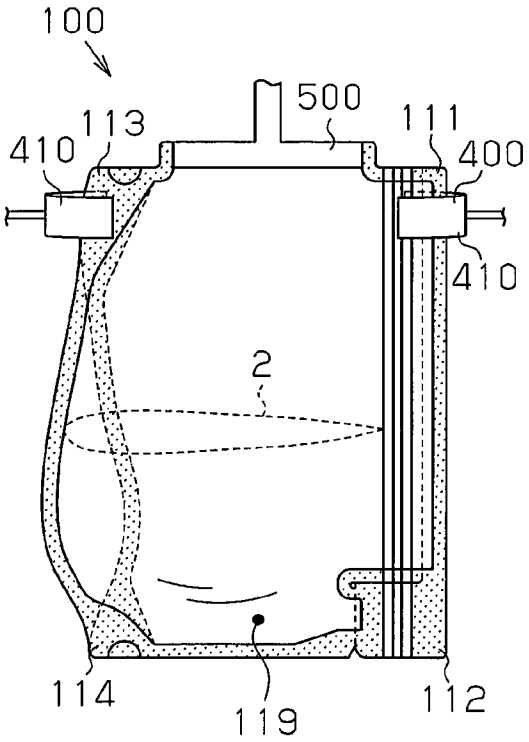
Figure 5A:
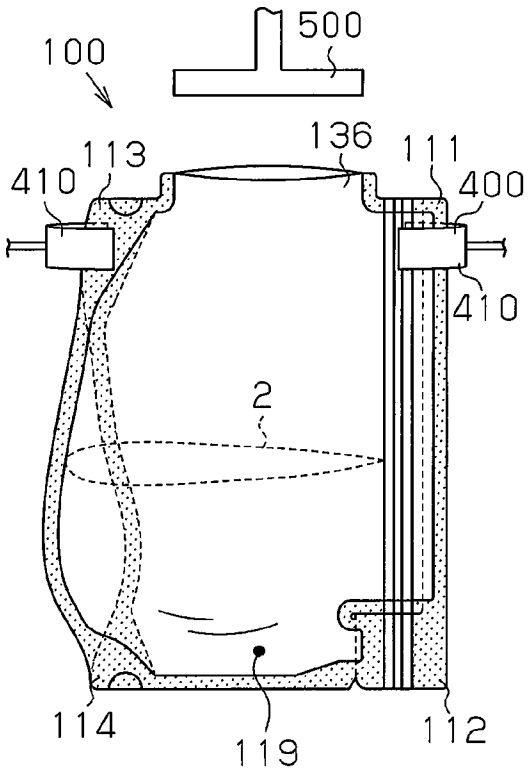

The manufacturing process of the content sealing pouch 1 includes a first step, a second step (FIG. 4(*a*)), a third step (FIG. 4(*b*)), a fourth step (FIG. 4(*c*)), a fifth step (FIG. 5(*a*)), a sixth step (FIG. 5(*b*)), and a seventh step (FIG. 5(*c*)).

In the first step, the pouch 100 is manufactured.

In the second step, the periphery of the first corner 111 and the periphery of the third corner 113 in the pouch 100 each are chucked with a chuck 410 of a filler 400.

The pouch 100 in the state shown in FIG. 4(*a*) is conveyed to a filling line. At a predetermined filling line position, the second opening 136 is opened by using a suction cup (not shown).

In the third step, as shown in FIG. 4(*b*), the nozzle 420 is inserted into the second opening 136. The nozzle 420 fills the internal space 119 with the content 2.

In the fourth step, as shown in FIG. 4(*c*), a predetermined amount of the content 2 is introduced into the internal space 119 to finish filling. After completion of filling with the content 2 in the internal space 119, the nozzle 420 is pulled out of the second opening 136.

In the fifth step, as shown in FIG. 5(*a*), with the periphery of the first corner 111 and the periphery of the third corner 113 being chucked with the chuck 410 of the filler 400, the pouch 100 is conveyed to a sealing line.

In the sixth step, as shown in FIG. 5(*b*), at a predetermined sealing line position, a sealing device 500 pinches the second opening 136. This seals the second opening 136.

In the seventh step, after sealing, as shown in FIG. 5(*c*), the sealing device 500 cancels pinching of the second opening 136.

Figure 6:
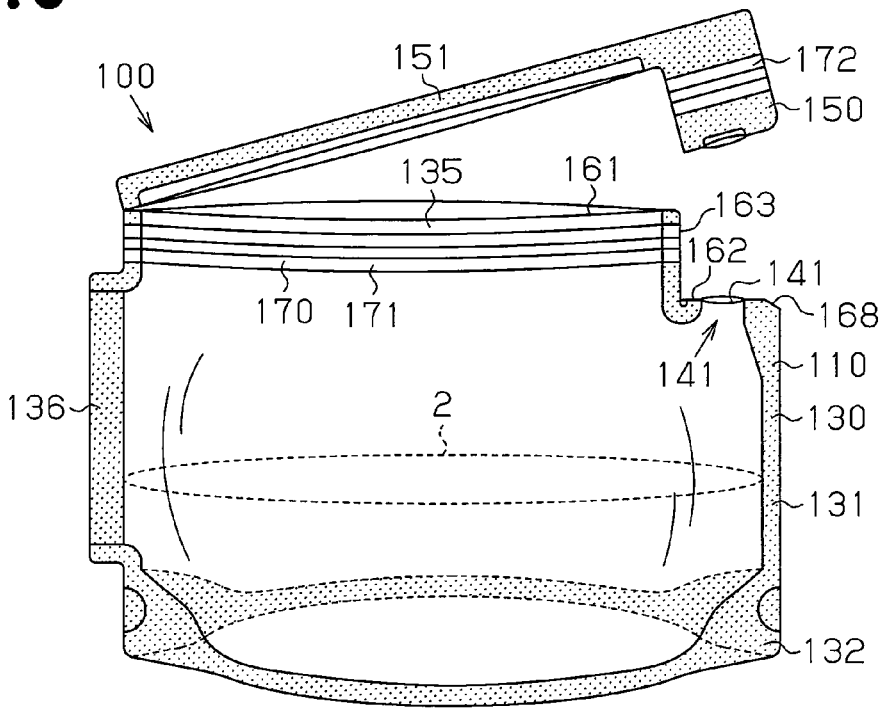
FIG. 6 is a front view of the content sealing pouch of FIG. 3 in a state where a second bag portion is separated from a first bag portion.

With reference to FIG. 6, a usage of the content sealing pouch 1 will be described.

By cutting the vapor passage guide line 162, the cutting portion 163, and the opening guide line 161 in this order using the notch 168 as a starting point, the bag 110 is divided into the first bag portion 130 and the second bag portion 150 (hereinafter referred to as "separated state"). This causes the internal space 119 to communicate with the outside through the vapor passage 141.

In the separated state, the first opening 135 can be opened and closed with the opening fastener portion 171. By opening the first opening 135, the user can add materials such as meat and vegetables into the internal space 119. After accommodating desired materials in the internal space 119, the user closes the first opening 135 with the opening fastener portion 171. After that, the content 2 and the added materials are cooked by heating the first bag portion 130 in a microwave oven.

The pouch 100 of the present embodiment has the following advantages.

(1) The bag 110 has the second opening 136. Thus, in the manufacturing process of the content sealing pouch 1, the content 2 can be placed into the internal space 119 of the bag 110 through the second opening 136. This reduces the possibility that the contents 2 adhere to the fastener 170 in the manufacturing process of the content sealing pouch 1.

(2) The bag 110 includes the opening sealing portion 151. This reduces the possibility that the fastener 170 is opened in the manufacturing process of the content sealing pouch 1. As a result, the possibility that the contents 2 adhere to the fastener 170 is further reduced.

(3) The bag 110 has the second opening 136 protruding from the first lateral portion 131A of the bag body 131. Thus, when the second opening 136 is sealed in the manufacturing process of the content sealing pouch 1, the chuck 410 of the filler 400 can located outside the moving path of the sealing device 500. This facilitates sealing of the second opening 136.

(4) The bag 110 includes the vapor passage portion 140 for removing vapor from the internal space 119. Thus, in the state where the vapor passage sealing portion 152 is separated from the vapor passage portion 140, when internal pressure rises due to vapor generated by heating of the contents 2, vapor in the internal space 119 are discharged to the outside through the vapor passage 141 of the vapor passage portion 140. This suppresses excessive expansion of the bag 110.

(5) The cutting portion 163 of the pouch 100 corresponds to the end 162A of the vapor passage guide line 162. Thus, by separating the vapor passage sealing portion 152 from the vapor passage portion 140 along the vapor passage guide line 162, the vapor passage fastener portion 172 is separated from the opening fastener portion 171. Accordingly, the operation of separating the vapor passage sealing portion 152 from the vapor passage portion 140 and the operation of separating the vapor passage fastener portion 172 from the opening fastener portion 171 are combined into one consecutive operation.

(6) The cutting portion 163 of the bag 110 includes the first predetermined cutting portion 165 and the second predetermined cutting portion 166. For this reason, as compared to the configuration including no first predetermined cutting portion 165 and no second predetermined cutting portion 166, the bag predetermined portion 137 can be separated from the remaining part of the bag 110 more easily.

Due to the presence of the first predetermined cutting portion 165 and the second predetermined cutting portion 166, when a force to separate a section on an extension of the intermediate cutting portion 164 in the bag 110 acts on the bag 110, a region in the bag predetermined portion 137 that is closer to the side of the internal space 119 than an end of the second predetermined cutting portion 166 can be cut in order from the second predetermined cutting portion 166. When the cutting in order from the second predetermined cutting portion 166 reaches the internal space 119, the internal space 119 cannot be sealed.

In consideration of such prediction, in the bag 110, the separating portion 167 is formed between the first predetermined cutting portion 165 and the second predetermined cutting portion 166. Thus, when the force to separate the section on the extension of the intermediate cutting portion 164 in the bag 110 acts on the bag 110, this force acts as a force to cut the separating portion 167. For this reason, the possibility is reduced that the region in the bag predetermined portion 137 that is closer to the internal space 119 than the end of the second predetermined cutting portion 166 is cut in order from the second predetermined cutting portion 166.

(7) The bag 110 includes the cutting restraining portion 138. Thus, when the force to separate the section on the extension of the intermediate cutting portion 164 in the bag 110 acts on the bag 110, the bag predetermined portion 137 is suppressed from being cut up to the internal space 119 by this force.

Second Embodiment

Figure 7:
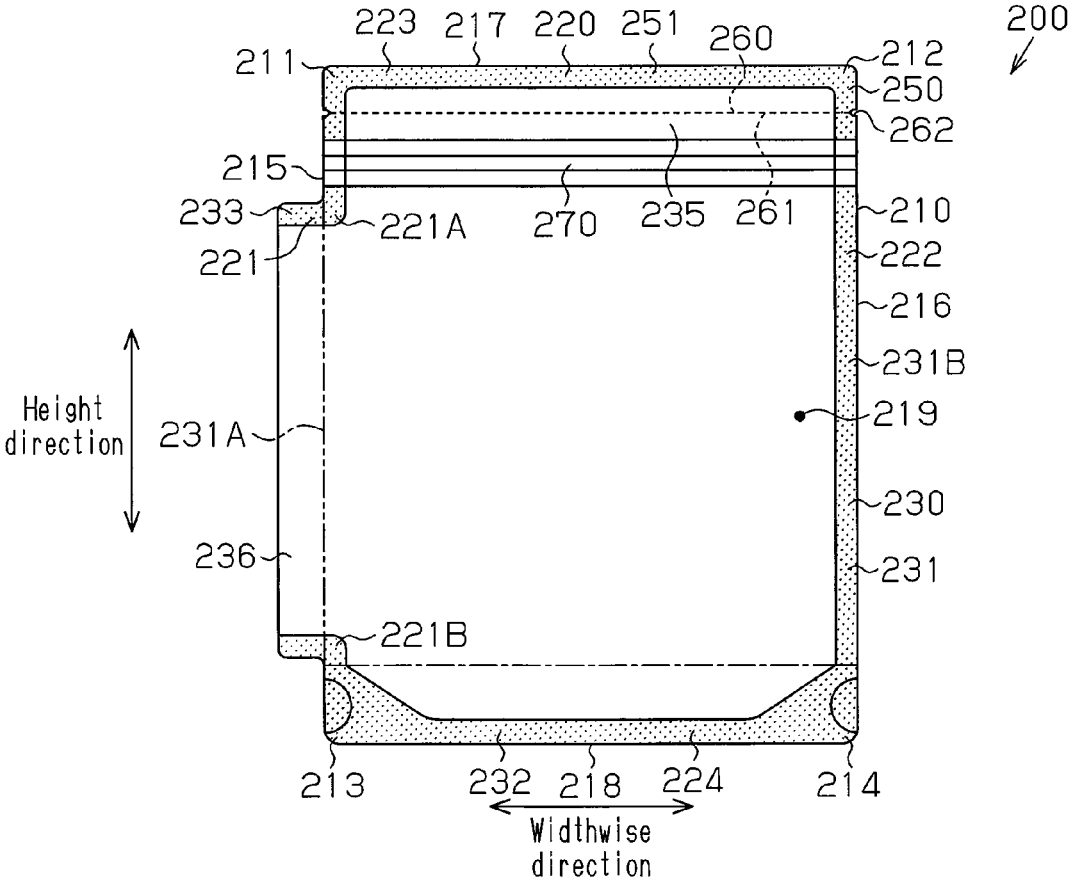
FIG. 7 is a front view of a pouch according to a second embodiment.

With reference to FIG. 7, the configuration of a pouch 200 will be described. A dotted part shown in FIG. 7 represents a sealing portion 220 of the pouch 200. In following description, the widthwise direction of the pouch 200 is orthogonal to the height direction of the pouch 200 in a front view of the pouch 200.

The pouch 200 has a form of a standing pouch. The pouch 200 includes a bag 210 and a fastener 270. The entire edge of the pouch 200 is sealed except for a second opening 236.

The bag 210 includes a first bag portion 230, a second bag portion 250, the sealing portion 220, and a guide line 260. The bag 210 is formed of a laminated sheet. The laminated sheet has an outermost layer, an intermediate layer, and an innermost layer. The outermost layer is a layer located on the outermost side in the bag 210, and is formed of a polyethylene terephthalate layer. The innermost layer is a layer located on the innermost side in the bag 210, and is formed of a non-oriented polypropylene layer. The intermediate layer includes a print layer, a first adhesive layer, an oriented nylon layer, and a second adhesive layer. The print layer is formed inside the outermost layer. The first adhesive layer is formed inside the print layer. The oriented nylon layer is formed inside the first adhesive layer. The second adhesive layer is formed inside the oriented nylon layer. The innermost layer is formed inside the second adhesive layer. The print layer has pictures, item description, and the like on its outer surface.

The bag 210 includes a first corner 211, a second corner 212, a third corner 213, a fourth corner 214, a first side edge 215, a second side edge 216, an upper edge 217, a lower edge 218, and an internal space 219.

The first side edge 215 forms an edge from the first corner 211 to the third corner 213 in the bag 210. The second side edge 216 forms an edge from the second corner 212 to the fourth corner 114 in the bag 210. The upper edge 217 forms an edge from the first corner 211 to the second corner 212 in the bag 210. The lower edge 218 forms an edge from the third corner 213 to the fourth corner 214 in the bag 210.

The first side edge 215 is continuous with the upper edge 217 at the first corner 211. The first side edge 215 is continuous with the lower edge 218 at the third corner 213. The second side edge 216 is continuous with the upper edge 217 at the second corner 212. The second side edge 216 is continuous with the lower edge 218 at the fourth corner 214.

The first bag portion 230 includes a bag body 231, a bottom gusset 232, and a protruding portion 233.

The bag body 231 includes a first lateral portion 231A, a second lateral portion 231B, a first opening 235, and the second opening 236.

The first lateral portion 231A corresponds to a region that is closer to the internal space 219 than a long dashed double-short dashed line in the drawing.

The second lateral portion 231B corresponds to a region including the second side edge 216.

The first opening 235 is located in the upper edge of the first bag portion 230 including the fastener 270.

In the state where the bag 210 is divided into the first bag portion 230 and the second bag portion 250, the first opening 235 functions to accommodate contents into the internal space 219.

The second opening 236 is provided in a protruding portion extending outward in the widthwise direction from the first lateral portion 231A. The second opening 236 functions to accommodate contents into the internal space 219.

The bottom gusset 232 supports the bag body 231. A long dashed short dashed line in the drawing represents the boundary between the bottom gusset 232 and the bag body 231.

The protruding portion 233 protrudes outward in the widthwise direction from the first lateral portion 231A. The protruding portion 233 includes the second opening 236.

The second bag portion 250 includes an opening sealing portion 251.

The opening sealing portion 251 is formed in the upper edge 217. The opening sealing portion 251 closes the first opening 235.

The sealing portion 220 is formed by thermal welding. The sealing portion 220 includes a first lateral sealing portion 221, a second lateral sealing portion 222, an upper sealing portion 223, and a lower sealing portion 224.

The first lateral sealing portion 221 seals a predetermined region including the first side edge 215 in the bag 210. The first lateral sealing portion 221 includes a lateral sealing upper part 221A and a lateral sealing lower part 221B. The lateral sealing upper part 221A is separated from the lateral sealing lower part 221B by the second opening 236.

The lateral sealing upper part 221A seals a region from the first corner 211 to the second opening 236 in the bag 210.

The lateral sealing lower part 221B seals the boundary between the bag body 231 and the bottom gusset 232 in the second opening 236.

The second lateral sealing portion 222 seals a predetermined region including the second side edge 216 in the bag 210. The upper sealing portion 223 seals a predetermined region including the upper edge 217. The upper sealing portion 223 includes the opening sealing portion 251. The lower sealing portion 224 seals a predetermined region including the lower edge 218.

The guide line 260 includes an opening guide line 261 and a notch 262. The opening guide line 261 is formed to separate the first bag portion 230 from the second bag portion 250 in the bag 210. The notch 262 is located at the point of contact between the opening guide line 261 and the second side edge 216. The notch 262 functions as a starting point where the bag 210 is cut along the opening guide line 261.

The fastener 270 opens and closes the first opening 235.

A usage of the pouch 200 will be described.

In the pouch 200, the internal space 219 is filled with contents through the second opening 236. In the pouch 200, the internal space 219 is filled with contents in the same procedure as that in the pouch 100 of the first embodiment.

In the pouch 200, the user separates the second bag portion 250 from the first bag portion 230.

The user opens the fastener 270, and adds materials such as meat and vegetables into the internal space 219. After accommodating desired materials in the internal space 219, the user closes the first opening 235 with the fastener 270. After that, the user heats the first bag portion 230 in the microwave oven. This cooks the contents and the added materials.

Heating of the first bag portion 230 in the microwave oven causes vapor from the contents. As a result, the pressure in the internal space 219, that is, internal pressure of the internal space 219 rises. When the internal pressure of the internal space 219 rises to a predetermined pressure, the fastener 270 is opened. Thus, vapor generated in the internal space 219 is discharged to external space through the fastener 270. This suppresses an excessive rise of internal pressure of the internal space 219.

The pouch 200 of the present embodiment has the above described advantages (1) through (3).

Third Embodiment

Figure 8:
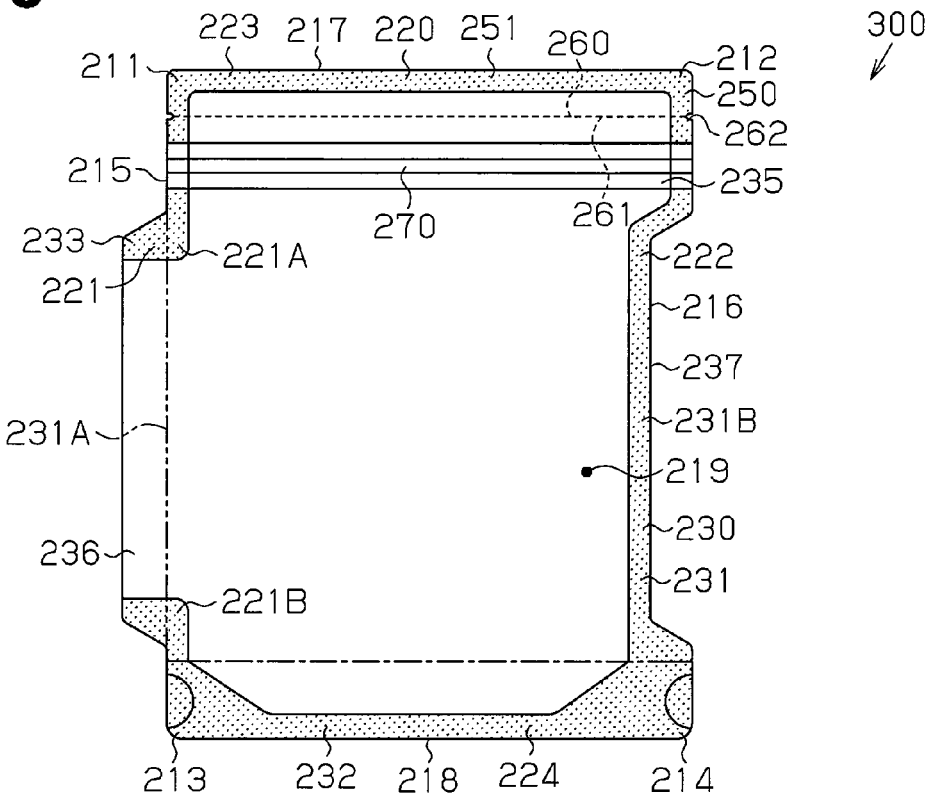
FIG. 8 is a front view of a pouch according to a third embodiment.

A main difference between a pouch 300 of a third embodiment shown in FIG. 8 and FIG. 9 and the pouch 200 of the second embodiment shown in FIG. 7 is as follows. That is, in the pouch 200 of the second embodiment, the second lateral portion 231B has no recess. In contrast, in the pouch 300 of the present embodiment, the second lateral portion 231B has a recess. Details of the difference from the pouch 200 of the second embodiment will be described below.

The second lateral portion 231B of the first bag portion 230 includes the second side edge 216. The second lateral portion 231B is opposite to the first lateral portion 231A. The second lateral portion 231B includes a recess 237 corresponding to the protruding portion having the second opening 236.

Figure 9:
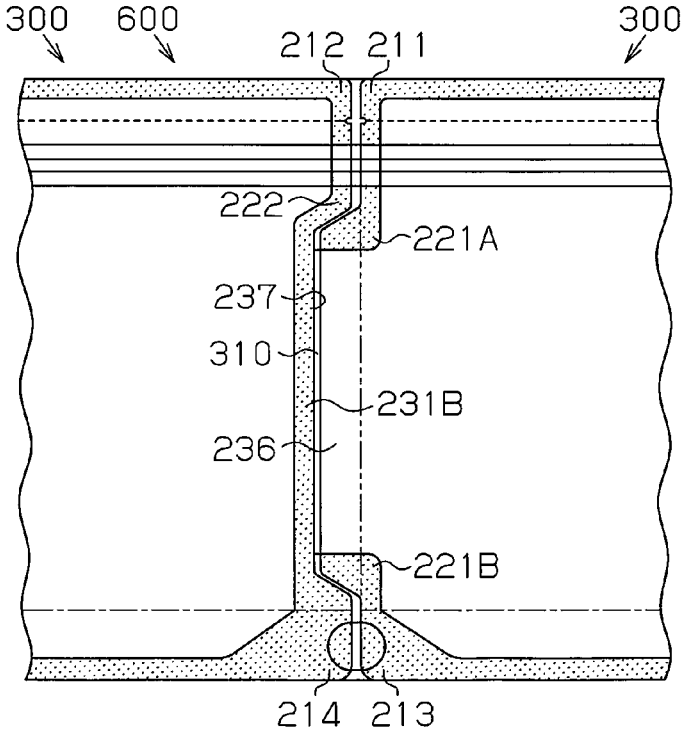
FIG. 9 is a plan view of a sheet for forming the pouch of FIG. 8.

With reference to FIG. 9, a manufacturing process of the pouch 300 will be described.

The pouch 300 is manufactured by cutting a pouch pattern sheet 600, in which patterns of pouches 300 are arranged on one sheet. In each adjacent pair of patterns of pouches 300, the second lateral portion 231B of one pattern is located in the second opening 236 of the other pattern. A waste portion 310 between the adjacent patterns of pouches 300 is cut with a cutter.

The pouch 300 of the present embodiment has the following advantage in addition to the above described advantages (1) through (3).

(8) The second lateral portion 231B of the bag 210 includes the recess 237 corresponding to the protruding portion having the second opening 236. Thus, in each adjacent pair of patterns of pouches 300, the second lateral portion 231B of one pattern can be located in the second opening 236 of the other pattern. This increases yields.

Fourth Embodiment

Figure 10:
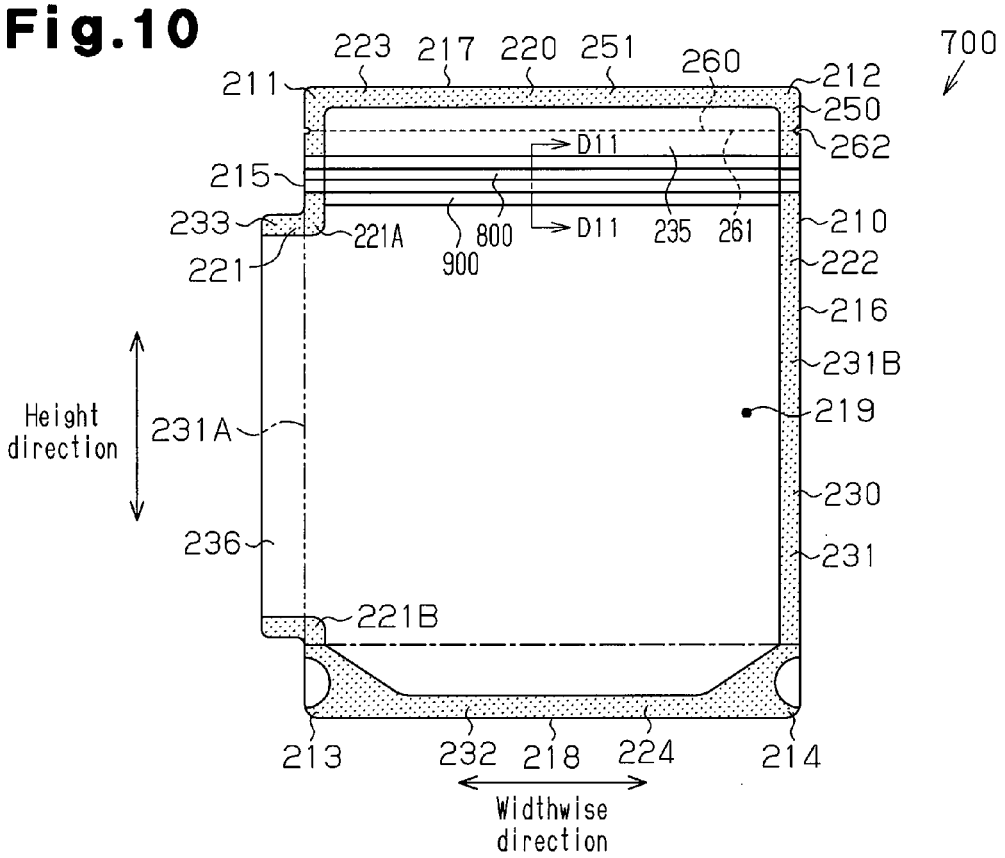
FIG. 10 is a front view of a pouch according to a fourth embodiment.

A main difference between a pouch 700 of a fourth embodiment shown in FIG. 10 and the pouch 200 of the second embodiment shown in FIG. 7 is as follows. That is, the pouch 200 of the second embodiment includes the fastener 270. In contrast, the pouch 700 of the present embodiment includes a fastener 800 and an easily-openable sealing portion 900. Details of the difference from the pouch 200 of the second embodiment will be described below.

The configuration of the fastener 800 and the easily-openable sealing portion 900 will be described.

Figure 11:
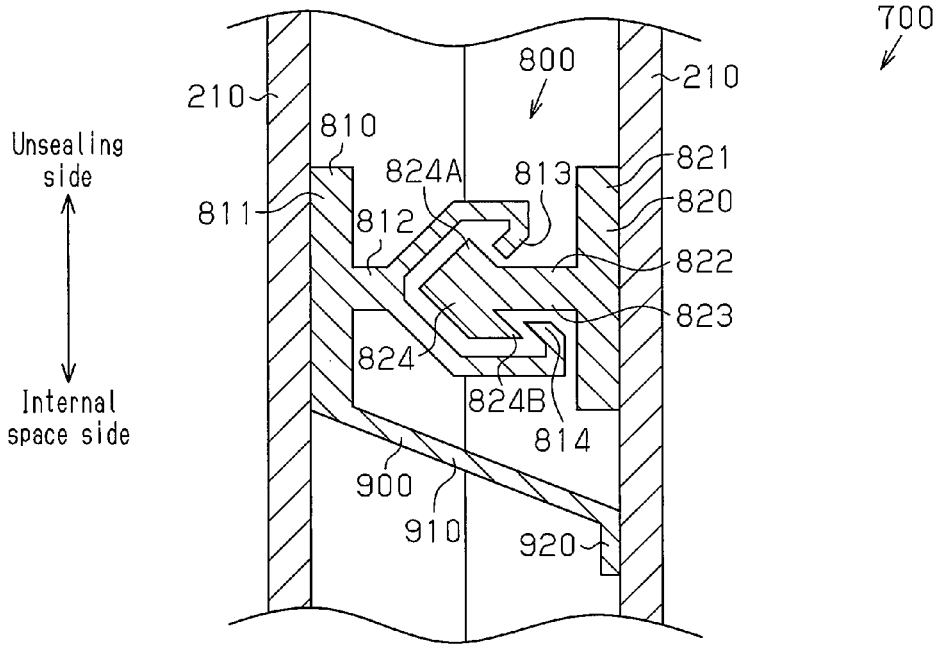
FIG. 11 is a cross-sectional view taken along line D11-D11 in FIG. 10.

As shown in FIG. 11, the fastener 800 includes a female track 810 and a male track 820. The female track 810 includes a female track base 811 and a female track main portion 812.

The female track base 811 is thermally welded to the sheet forming the bag 210. The female track base 811 supports the female track main portion 812.

The female track main portion 812 is shaped like a bowl. The female track main portion 812 is integral with the female track base 811. The female track main portion 812 includes an unsealing-side claw 813 and a content-side claw 814.

The unsealing-side claw 813 is bent toward the female track base 811. The unsealing-side claw 813 is located closer to the unsealing side of the bag 210 than the content-side claw 814.

The content-side claw 814 is bent toward the female track base 811. The content-side claw 814 is located closer to the internal space 119 of the bag 210 than the unsealing-side claw 813.

The male track 820 includes a male track base 821 and a male track main base 822.

The male track base 821 is thermally welded to the sheet forming the bag 210. The male track base 821 supports the male track main base 822.

The male track main base 822 is shaped like an arrowhead. The male track main base 822 is integral with the male track base 821. The male track main base 822 includes a support portion 823 and a distal end 824. The support portion 823 is formed to be continuous with the male track base 821. The support portion 823 protrudes from the male track base 821 toward the female track base 811.

The distal end 824 is formed to be continuous with the support portion 823. The distal end 824 includes an unsealing-side claw 824A and a content-side claw 824B. The unsealing-side claw 824A engages with the unsealing-side claw 813 of the female track main portion 812. The content-side claw 824B engages with the content-side claw 814 of the female track main portion 812. The engaging strength between the content-side claw 824B and the content-side claw 814 is larger than the engaging strength between the unsealing-side claw 824A and the unsealing-side claw 813. Accordingly, the fastener 800 is easier to be opened from the unsealing side than from the internal space side.

The easily-openable sealing portion 900 functions to suppress contents in the internal space 219 from adhering to the fastener 800. The easily-openable sealing portion 900 closes the first opening 235. The easily-openable sealing portion 900 is located closer to the internal space 219 than the fastener 800. The easily-openable sealing portion 900 includes a main portion 910 and a bag sealing portion 920.

The main portion 910 is made of the same material as the material for the female track base 811 of the fastener 800, and is integral with the female track base 811. The main portion 910 is made of the same material as the material for the bag sealing portion 920, and is integral with the bag sealing portion 920.

The bag sealing portion 920 is sealed to the inner circumferential surface of the bag 210. The bag sealing portion 920 has a lower sealing strength than the sealing portion 220.

Figures 12A, 12B, 12C:
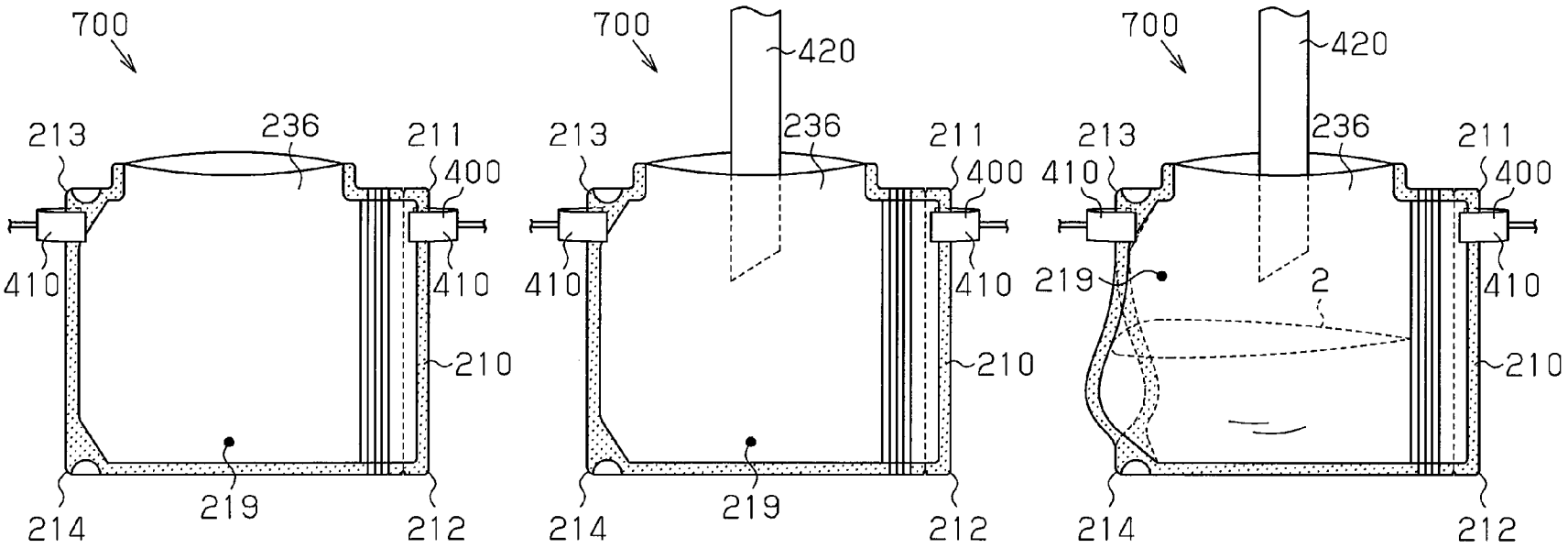
FIGS. 12(*a*)-12(*c*) are diagrams showing a manufacturing process of the content sealing pouch of FIG. 10, where FIG. 12(*a*) is a front view of the pouch with a second opening being opened, FIG. 12(*b*) is a front view of the pouch into which a nozzle of a filler is inserted through the second opening, and FIG. 12(*c*) is a front view of the pouch with contents in an internal space.

With reference to FIGS. 12(*a*)-(*c*) and FIGS. 13(*a*)-(*c*), a manufacturing process of a content sealing pouch 710 using the pouch 700 will be described.

Figures 13A, 13B, 13C:
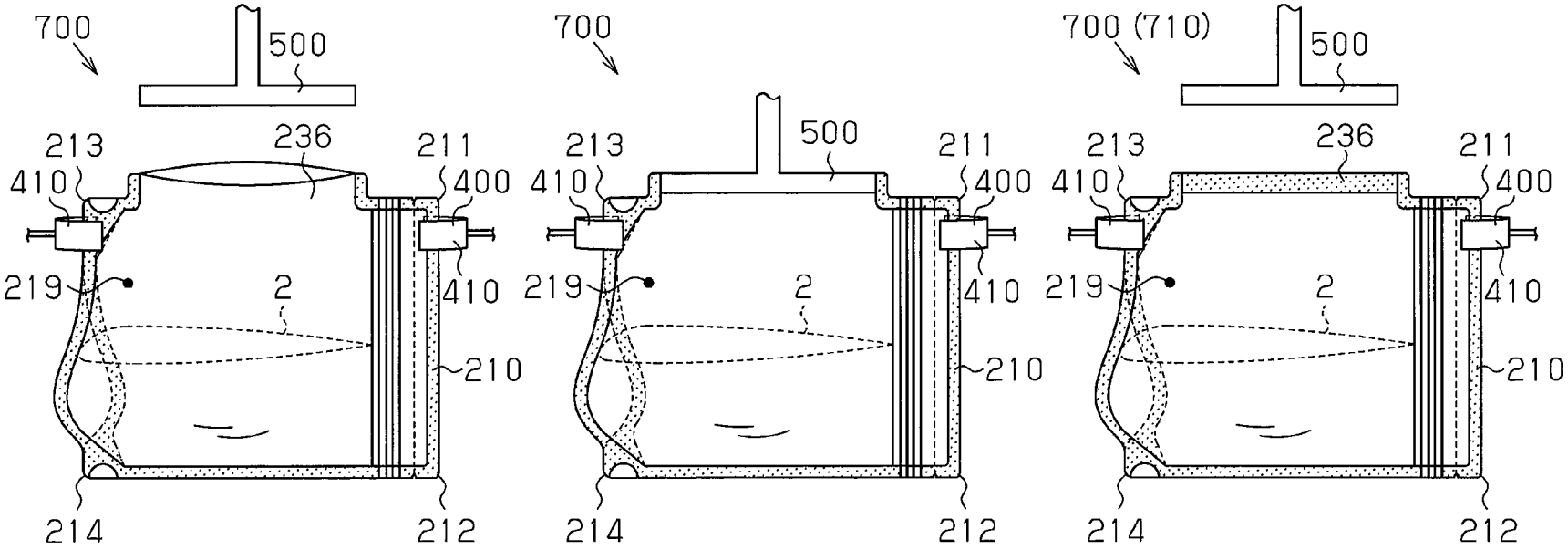
FIGS. 13(*a*)-13(*c*) are diagrams showing a manufacturing process of the content sealing pouch of FIG. 10, where FIG. 13(*a*) is a front view of the pouch before sealing of the second opening, FIG. 13(*b*) is a front view of the pouch during sealing of the second opening, and FIG. 13(*c*) is a front view of the pouch after sealing of the second opening.

The manufacturing process of the content sealing pouch 710 includes a first step, a second step (FIG. 12(*a*)), a third step (FIG. 12(*b*)), a fourth step (FIG. 12(*c*)), a fifth step (FIG. 13(*a*)), a sixth step (FIG. 13(*b*)), and a seventh step (FIG. 13(*c*)).

In the first step, the pouch 700 is manufactured.

In the second step, the periphery of the first corner 211 and the periphery of the third corner 213 in the pouch 700 each are chucked with the chuck 410 of the filler 400.

The pouch 700 in the state shown in FIG. 12(*a*) is conveyed to a filling line. At a predetermined filling line position, the second opening 236 is opened with a suction cup (not shown).

In the third step, as shown in FIG. 12(*b*), the nozzle 420 is inserted into the second opening 236. The nozzle 420 the internal space 219 with the content 2.

In the fourth step, as shown in FIG. 12(*c*), the internal space 219 is filled with a predetermined amount of content 2 to complete filling. After completion of filling of the internal space 219 with the content 2, the nozzle 420 is pulled out of the second opening 236.

In the fifth step, as shown in FIG. 13(*a*), with the periphery of the first corner 211 and the periphery of the third corner 213 in the pouch 700 each being chucked with the chuck 410 of the filler 400, the pouch 700 is conveyed to a sealing line.

In the sixth step, as shown in FIG. 13(*b*), at a predetermined sealing line position, the sealing device 500 pinches the second opening 236. This seals the second opening 236.

In the seventh step, after sealing, as shown in FIG. 13(*c*), the sealing device 500 cancels the pinching of the second opening 236.

The pouch 700 of the present embodiment has the following advantage in addition to the above described advantages (1) through (3).

(9) The bag 210 includes the easily-openable sealing portion 900. The easily-openable sealing portion 900 closes the first opening 235. The easily-openable sealing portion 900 is located closer to the internal space 219 than the fastener 800. Thus, when the content 2 is placed in the internal space 219 of the bag 210 through the second opening 236, the possibility that the content 2 adheres to the fastener 800 is further reduced.

A main difference between a pouch 950 of a fifth embodiment shown in FIG. 14 and the like and the pouch 200 of the second embodiment shown in FIG. 7 is as follows. That is, in the pouch 200 of the second embodiment, the sealing portion 220 includes no vapor passage portion. In contrast, in the pouch 950 of the present embodiment, the sealing portion 220 has a vapor passage portion 951. Details of the difference from the pouch 200 of the second embodiment will be described below.

Figure 14:
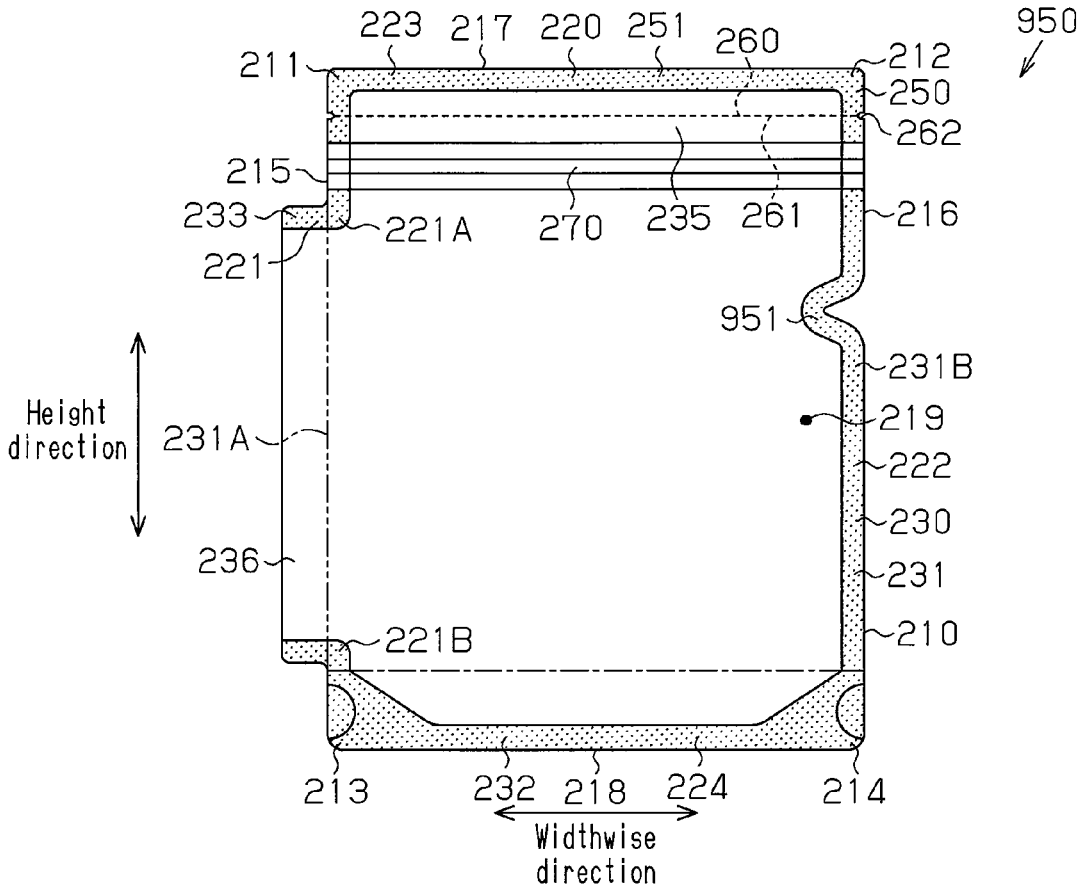
FIG. 14 is a front view of a pouch according to an embodiment.

With reference to FIG. 14, the configuration of the vapor passage portion 951 will be described.

The vapor passage portion 951 functions to discharge vapor generated in the internal space 219 from the internal space 219 to external space. The vapor passage portion 951 is dented from the outer side toward the inner side of the pouch 200 in the widthwise direction. The vapor passage portion 951 is formed by denting a portion of the second lateral sealing portion 222 from the outer side toward the inner side in the widthwise direction.

Usage of the pouch 950 will be described.

In the pouch 950, the internal space 219 is filled with contents through the second opening 236. In the pouch 950, the internal space 219 is filled with the contents in the same procedure as in the pouch 100 in the first embodiment.

For the pouch 950, the user separates the second bag portion 250 from the first bag portion 230.

The user opens the fastener 270, and adds materials such as meat and vegetables to the internal space 219. After accommodating the materials in the internal space 219, the user closes the first opening 235 with the fastener 270. Then, the user heats the first bag portion 230 in a microwave oven. This cooks the contents and the added materials.

Figure 15:
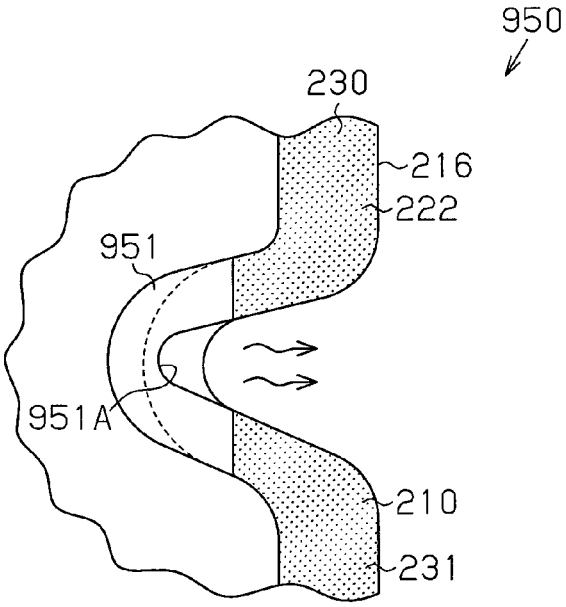
FIG. 15 is an enlarged view of a vapor passage portion of the pouch of FIG. 14.

Heating the first bag portion 230 in the microwave oven causes vapor from the contents. As a result, internal pressure of the internal space 219 rises. As shown in FIG. 15, when the internal pressure of the internal space 219 rises to a predetermined pressure, sealing of the vapor passage portion 951 is peeled. This forms an opening 951A in the vapor passage portion 951. The vapor generated in the internal space 219 is discharged to external space through the opening 951A. This suppresses an excessive rise of internal pressure of the internal space 219.

Sixth Embodiment

Figure 16:
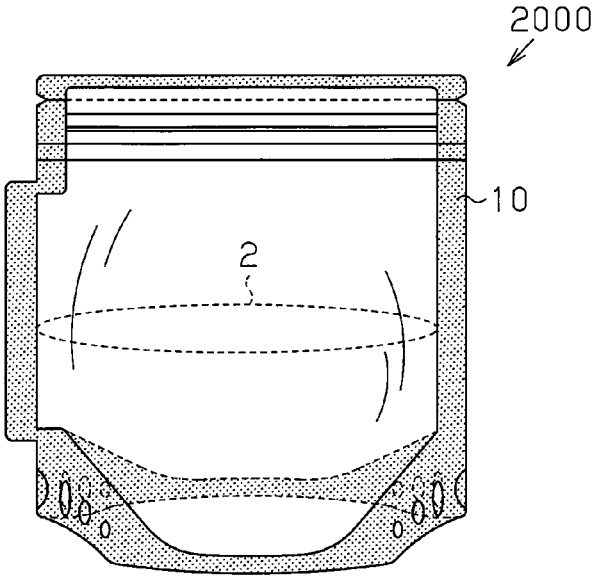
FIG. 16 is a front view of a content sealing pouch according to a sixth embodiment.

With reference to FIG. 16, the configuration of a content sealing pouch 2000 will be described. A dotted part shown in FIG. 16, FIG. 7, and FIGS. 20 to 25 represents a sealing portion of a pouch 10.

The content sealing pouch 2000 includes the pouch 10 and content 2. The pouch 10 has a form of a standing pouch. A second opening 61 of the pouch 10 (see FIG. 17) is sealed. The content 2 is liquid condiment.

Figure 17:
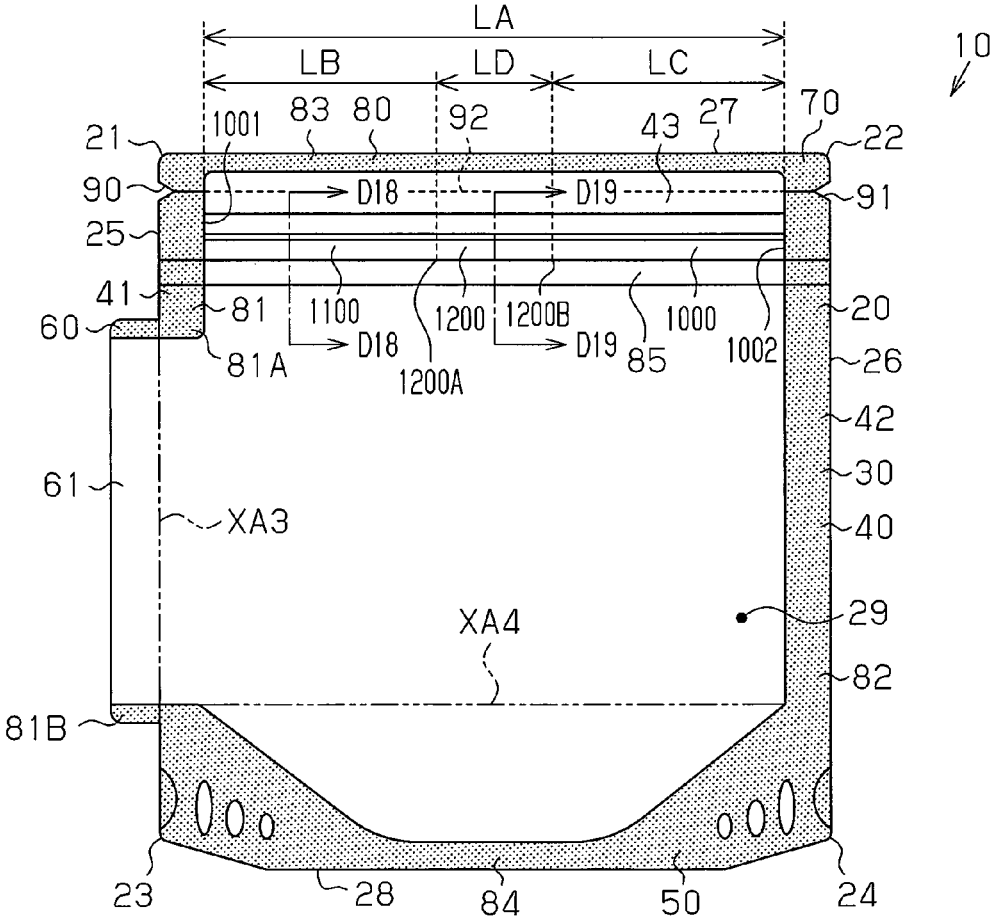
FIG. 17 is a front view of the pouch of the sixth embodiment.

With reference to FIG. 17, the configuration of the pouch 10 will be described.

The pouch 10 includes a bag 20 and a fastener 1000. The entire edge of the pouch 10 is sealed except for the second opening 61.

The bag 20 includes a primary bag portion 30, a secondary bag portion 70, a sealing portion 80, and a cutting assist portion 90. The bag 20 is formed of a laminated sheet. The laminated sheet includes an outermost layer, an intermediate layer, and an innermost layer. The outermost layer is a layer located on the outermost side in the bag 20, and is formed of a polyethylene terephthalate layer. The innermost layer is a layer located on the innermost side in the bag 20, and is formed of a non-oriented polypropylene layer. The intermediate layer includes a print layer, a first adhesive layer, an oriented nylon layer, and a second adhesive layer. The print layer is formed inside the outermost layer. The first adhesive layer is formed inside the print layer. The oriented nylon layer is formed inside the first adhesive layer. The second adhesive layer is formed inside the oriented nylon layer. The innermost layer is formed inside the second adhesive layer. The print layer has pictures, item description, etc. on its outer surface.

The bag 20 includes a first corner 21, a second corner 22, a third corner 23, a fourth corner 24, a first side edge 25, a second side edge 26, an upper edge 27, a lower edge 28, and an internal space 29.

The first side edge 25 forms an edge from the first corner 21 to the third corner 23 in the bag 20. The second side edge 26 forms an edge from the second corner 22 to the fourth corner 24 in the bag 20. The upper edge 27 forms an edge from the first corner 21 to the second corner 22 in the bag 20. The lower edge 28 forms an edge from the third corner 23 to the fourth corner 24 in the bag 20.

The first side edge 25 is continuous with the upper edge 27 at the first corner 21. The first side edge 25 is continuous with the lower edge 28 at the third corner 23. The second side edge 26 is continuous with the upper edge 27 at the second corner 22. The second side edge 26 is continuous with the lower edge 28 at the fourth corner 24.

The primary bag portion 30 includes a bag body 40, a bottom gusset 50, and a protruding portion 60.

The bag body 40 includes a first lateral portion 41, a second lateral portion 42, and a first opening 43.

The first lateral portion 41 corresponds to a region that is closer to the internal space 29 than a boundary line XA3 expressed by a long dashed double-short dashed line in the drawing. The second lateral portion 42 corresponds to a region including the second side edge 26.

The first opening 43 is formed in the upper edge of the primary bag portion 30 including the fastener 1000. In the state where the bag 20 is divided into the primary bag portion 30 and the secondary bag portion 70, the first opening 43 functions to accommodate contents in the internal space 29.

The bottom gusset 50 supports the bag body 40. A long dashed double-short dashed line XA4 in the drawing represents the boundary between the bottom gusset 50 and the bag body 40.

The protruding portion 60 protrudes outward in the widthwise direction from the first lateral portion 41. The protruding portion 60 includes the second opening 61. The second opening 61 functions to accommodate the contents in the internal space 29.

The secondary bag portion 70 is formed to be continuous with the primary bag portion 30 via the cutting assist portion 90.

The sealing portion 80 is formed by thermal welding. The sealing portion 80 includes a first lateral sealing portion 81, a second lateral sealing portion 82, an upper sealing portion 83, a lower sealing portion 84, and an easily-openable sealing portion 85.

The first lateral sealing portion 81 seals a predetermined region including the first side edge 25 in the bag 20. The first lateral sealing portion 81 includes a lateral sealing upper part 81A and a lateral sealing lower part 81B. The lateral sealing upper part 81A is separated from the lateral sealing lower part 81B by the second opening 61.

The lateral sealing upper part 81A seals a region from the first corner 21 to the second opening 61 in the bag 20.

The lateral sealing lower part 81B seals the boundary between the bag body 40 and the bottom gusset 50 in the second opening 61.

The second lateral sealing portion 82 seals a predetermined region including the second side edge 26 in the bag 20. The upper sealing portion 83 seals a predetermined region including the upper edge 27.

The upper sealing portion 83 is formed at the upper edge 27. The upper sealing portion 83 closes the first opening 43. The lower sealing portion 84 seals a predetermined region including the lower edge 28 in the bottom gusset 50. The easily-openable sealing portion 85 seals two sheets forming the bag body 40. The easily-openable sealing portion 85 closes the first opening 43. The easily-openable sealing portion 85 is formed between the fastener 1000 and the internal space 29.

The cutting assist portion 90 functions to divide the bag 20 into the primary bag portion 30 and the secondary bag portion 70. The cutting assist portion 90 includes a notch 91 and a guide line 92. The notch 91 functions as a trigger portion, that is, a start portion for dividing the bag 20 into the primary bag portion 30 and the secondary bag portion 70. The notch 91 is formed at the first side edge 25 and the second side edge 26. The guide line 92 assists in dividing the bag 20 into the primary bag portion 30 and the secondary bag portion 70. The guide line 92 is formed by half-cutting a film constituting the bag 20 with a laser.

The fastener 1000 functions to open and close the first opening 43. The fastener 1000 includes a first fastener end 1001, a second fastener end 1002, a high engaging-strength portion 1100, and a low engaging-strength portion 1200. The fastener 1000 has a fastener length LA. The fastener length LA is a length from the first fastener end 1001 to the second fastener end 1002.

The first fastener end 1001 is located on the inner edge of the lateral sealing upper part 81A. The second fastener end 1002 is located on the inner edge of the second lateral sealing portion 82.

The high engaging-strength portion 1100 includes a first section from the first fastener end 1001 to a first low-engaging end 1200A of the low engaging-strength portion 1200 and a second section from the second fastener end 1002 to a second low-engaging end 1200B of the low engaging-strength portion 1200.

The first section of the high engaging-strength portion 1100 has a first high engaging-strength portion length LB, and the second section of the high engaging-strength portion 1100 has a second high engaging-strength portion length LC. The first high engaging-strength portion length LB is a length from the first fastener end 1001 to the first low-engaging end 1200A. The second high engaging-strength portion length LC is a length from the second fastener end 1002 to the second low-engaging end 1200B. The first high engaging-strength portion length LB is equal to the second high engaging-strength portion length LC.

The low engaging-strength portion 1200 has a low engaging-strength portion length LD. The low engaging-strength portion length LD is a length from the first low-engaging end 1200A to the second low-engaging end 1200B. The low engaging-strength portion length LD is 20% of the fastener length LA.

Figure 18:
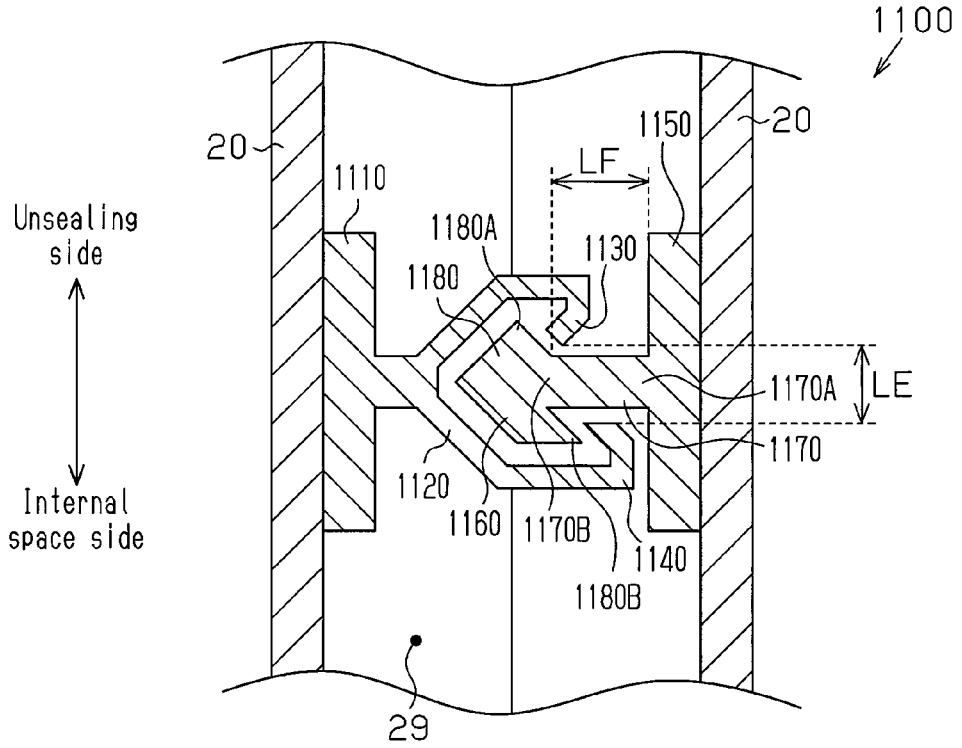
FIG. 18 is a cross-sectional view taken along line D18-D18 of FIG. 7, showing a high engaging-strength portion of the pouch.

With reference to FIG. 18, the configuration of the high engaging-strength portion 1100 will be described. FIG. 18 does not show the easily-openable sealing portion 85.

The high engaging-strength portion 1100 includes a female track base 1110, a normal female track 1120, a male track base 1150, and a normal male track 1160.

The female track base 1110 is thermally welded to the sheet forming the bag 20. The female track base 1110 supports the normal female track 1120.

The normal female track 1120 is shaped like a bowl. The normal female track 1120 is integral with the female track base 1110. The normal female track 1120 includes an unsealing-side normal claw 1130 and a content-side normal claw 1140. The unsealing-side normal claw 1130 is bent toward the female track base 1110. The unsealing-side normal claw 1130 is located closer to the unsealing-side of the bag 20 than the content-side normal claw 1140.

The content-side normal claw 1140 is bent toward the female track base 1110. The content-side normal claw 1140 is located closer to the internal space 29 of the bag 20 than the content-side normal claw 1130. The content-side normal claw 1140 and the unsealing-side normal claw 1130 have a normal distance LE therebetween. The normal distance LE is a distance between the content-side normal claw 1140 and the unsealing-side normal claw 1130 in the state where the normal female track 1120 engages with the normal male track 1160.

The male track base 1150 is thermally welded to the sheet forming the bag 20. The male track base 1150 supports the normal male track 1160.

The normal male track 1160 is shaped like an arrowhead. The normal male track 1160 is integral with the male track base 1150. The normal male track 1160 includes a normal support portion 1170 and a normal distal end 1180. The normal support portion 1170 is formed to be continuous with the male track base 1150. The normal support portion 1170 protrudes from the male track base 1150 toward the female track base 1110. The normal support portion 1170 includes a proximal-end boundary portion 1170A and distal-end boundary portion 1170B. The proximal-end boundary portion 1170A is the boundary between the normal support portion 1170 and the male track base 1150. The distal-end boundary portion 1170B is the boundary between the normal support portion 1170 and the normal distal end 1180. The normal support portion 1170 has a normal support portion length LF. The normal support portion length LF is a distance between the proximal-end boundary portion 1170A and the distal-end boundary portion 1170B.

The normal distal end 1180 is formed to be continuous with the normal support portion 1170. The normal distal end 1180 includes an unsealing-side normal claw 1180A and a content-side normal claw 1180B. The unsealing-side normal claw 1180A engages with the unsealing-side normal claw 1130 of the normal female track 1120. The content-side normal claw 1180B engages with the content-side normal claw 1140 of the normal female track 1120. The engaging strength between the content-side normal claw 1180B and the content-side normal claw 1140 is larger than the engaging strength between the unsealing-side normal claw 1180A and the unsealing-side normal claw 1130. Thus, the fastener 1000 can be opened more easily from the unsealing side than the side of the internal space.

Figure 19:
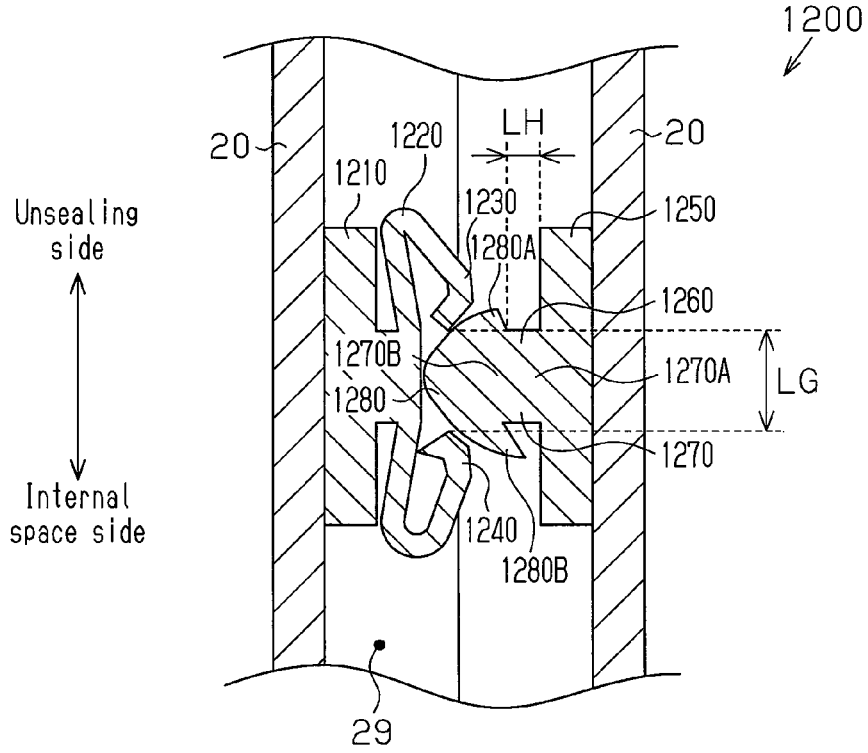
FIG. 19 is a cross-sectional view taken along line D19-D19 of FIG. 17, showing a low engaging-strength portion of the pouch.

With reference to FIG. 19, the configuration of the low engaging-strength portion 1200 will be described. FIG. 19 does not show the easily-openable sealing portion 85.

The engaging strength of the low engaging-strength portion 1200 is 0% of that of the high engaging-strength portion 1100. The low engaging-strength portion 1200 is formed by collapsing the fastener 1000 having the same configuration as the high engaging-strength portion 1100 under a predetermined pressure, a predetermined time, and a predetermined temperature. The low engaging-strength portion 1200 includes a female track base 1210, a deformable female track 1220, a male track base 1250, and a deformable male base 1260.

The female track base 1210 is thermally welded to the sheet forming the bag 20. The female track base 1210 supports the deformable female track 1220.

The deformable female track 1220 is shaped like a bowl. The deformable female track 1220 is integral with the female track base 1210. The deformable female track 1220 includes an unsealing-side deformable claw 1230 and a content-side deformable claw 1240. The unsealing-side deformable claw 1230 is bent toward the female track base 1210. The unsealing-side deformable claw 1230 is located closer to the unsealing side of the bag 20 than the content-side deformable claw 1240.

The content-side deformable claw 1240 is bent toward the female track base 1210. The content-side deformable claw 1240 is located closer to the internal space 29 of the bag 20 than the content-side deformable claw 1240. The content-side deformable claw 1240 and the unsealing-side deformable claw 1230 have a deformation length LG therebetween. The deformation length LG is a distance between the content-side deformable claw 1240 and the unsealing-side deformable claw 1230. The deformation length LG is larger than the normal distance LE in FIG. 3.

The male track base 1250 is thermally welded to the sheet forming the bag 20. The male track base 1250 supports the deformable male base 1260.

The deformable male base 1260 is shaped like an arrowhead. The deformable male base 1260 is integral with the male track base 1250. The deformable male base 1260 includes a deformable support portion 1270 and a deformable distal end 1280. The deformable support portion 1270 is formed to be continuous with the male track base 1250. The deformable support portion 1270 protrudes from the male track base 1250 toward the female track base 1210. The deformable support portion 1270 includes a proximal-end boundary portion 1270A and a distal-end boundary portion 1270B. The proximal-end boundary portion 1270A is the boundary between the deformable support portion 1270 and the male track base 1250. The distal-end boundary portion 1270B is the boundary between the deformable support portion 1270 and the deformable distal end 1280. The deformable support portion 1270 has a deformable support portion length LH. The deformable support portion length LH is a distance between the proximal-end boundary portion 1270A and the distal-end boundary portion 1270B. The deformable support portion length LH is shorter than the normal support portion length LF in FIG. 18.

The deformable distal end 1280 is formed to be continuous with the deformable support portion 1270. The deformable distal end 1280 includes an unsealing-side deformable claw 1280A and a content-side deformable claw 1280B. The unsealing-side deformable claw 1280A engages with the unsealing-side deformable claw 1230 of the deformable female track 1220. The engaging strength between the unsealing-side deformable claw 1280A and the unsealing-side deformable claw 1230 is 0%. The content-side deformable claw 1280B engages with the content-side deformable claw 1240 of the deformable female track 1220. The engaging strength between the content-side deformable claw 1280B and the content-side deformable claw 1240 is 0%.

Figure 20A:
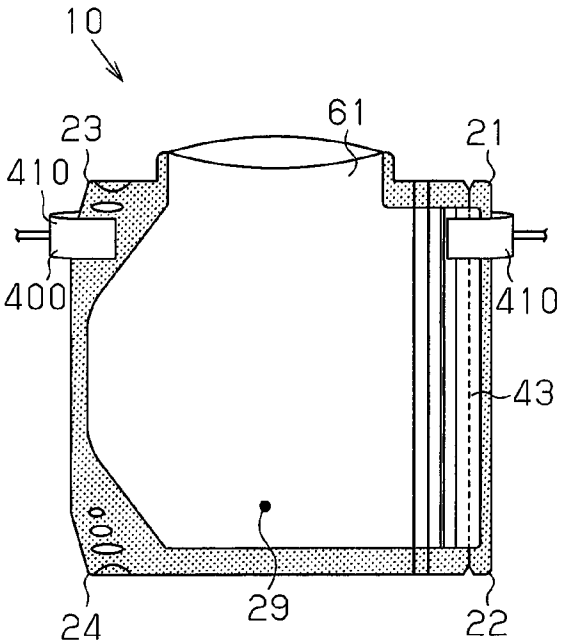
FIGS. 20(*a*)-20(*c*) are diagrams showing a manufacturing process of the content sealing pouch of FIG. 16, where FIG. 20(*a*) is a front view of the pouch with a second opening being opened, FIG. 20(*b*) is a front view of the pouch into which a nozzle of a filler is inserted through the second opening, and FIG. 20(*c*) is a front view of the pouch with contents in an internal space.
Figure 20B:
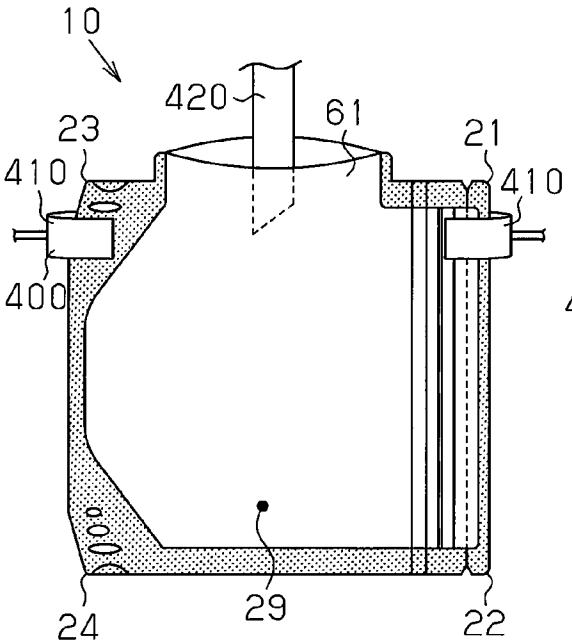
Figure 20C:
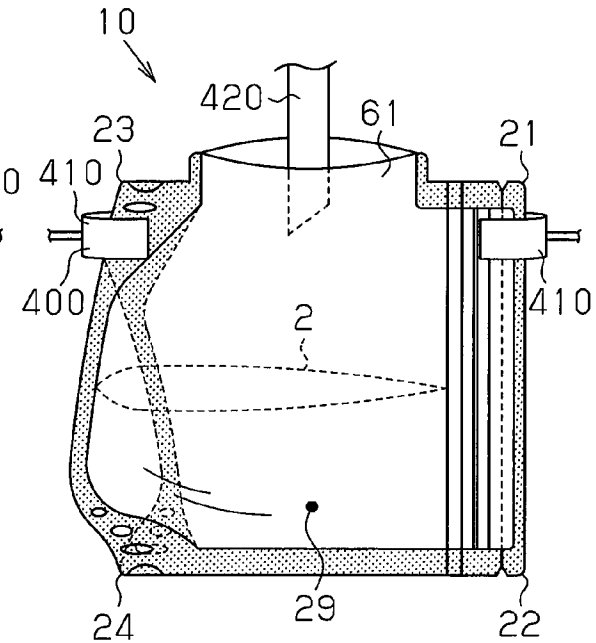

With reference to FIGS. 20(*a*)-(*c*) and FIGS. 21(*a*)-(*c*), a manufacturing process of the content sealing pouch 2000 will be described.

Figure 21A:
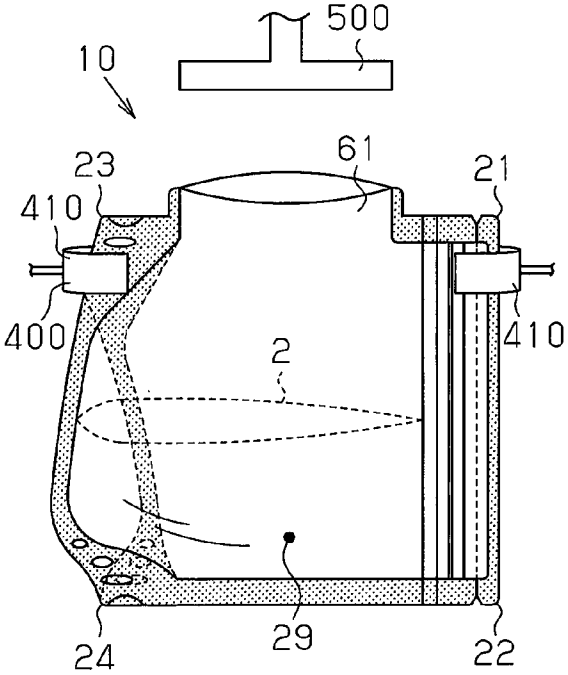
FIG. 21(*a*)-21(*c*) are diagrams showing a manufacturing process of the content sealing pouch of FIG. 16, where FIG. 21(*a*) is a front view of the pouch before sealing of the second opening, FIG. 21(*b*) is a front view of the pouch during sealing of the second opening, and FIG. 21(*c*) is a front view of the pouch after sealing of the second opening.
Figure 21B:
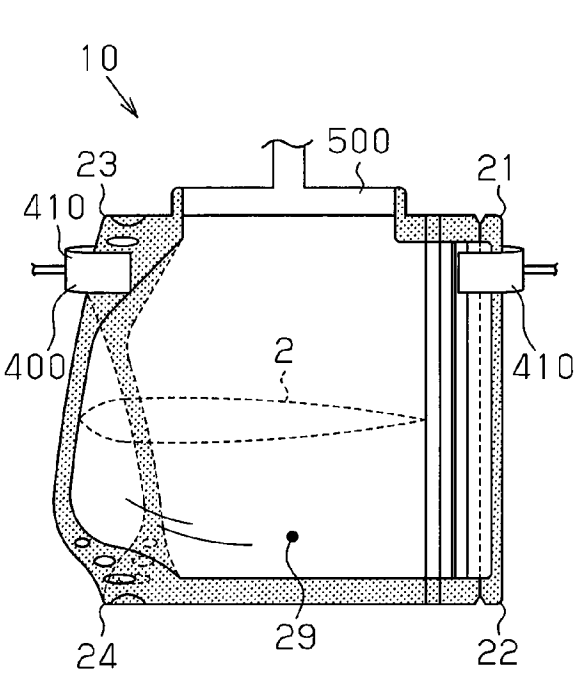
Figure 21C:
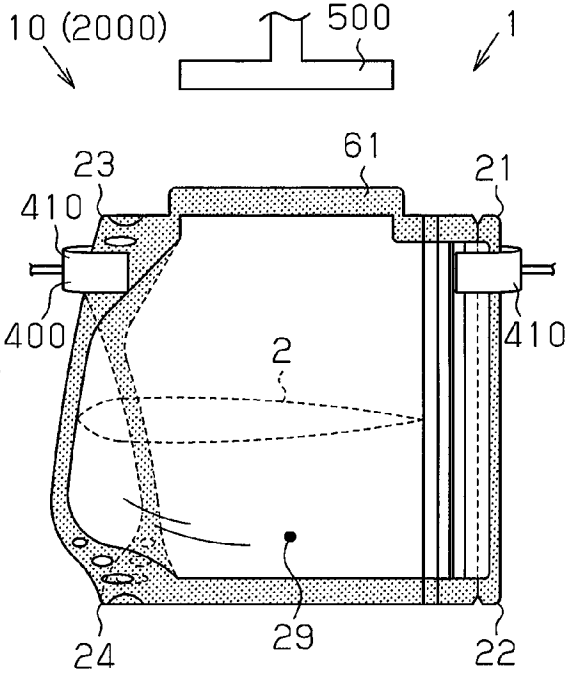

The manufacturing process of the content sealing pouch 2000 includes a first step, a second step (FIG. 20(*a*)), a third step (FIG. 20(*b*)), a fourth step (FIG. 20(*c*)), a fifth step (FIG. 21(*a*)), a sixth step (FIG. 21(*b*)), and a seventh step (FIG. 21(*c*)).

In the first step, the pouch 10 is manufactured.

In the second step, the periphery of the first corner 21 and the periphery of the third corner 23 in the pouch 10 each are chucked with the chuck 410 of the filler 400.

The pouch 10 in the state shown in FIG. 20(*a*) is conveyed to the filling line. At a predetermined filling line position, the second opening 61 is opened with a suction cup (not shown).

In the third step, as shown in FIG. 20(*b*), the nozzle 420 is inserted into the second opening 61. The nozzle 420 fills the internal space 29 with the content 2.

In the fourth step, as shown in FIG. 20(*c*), the internal space 29 is filled with a predetermined amount of content 2 to complete filling. After completion of filling of the internal space with the content 2, the nozzle 420 is pulled out of the second opening 61.

In the fifth step, as shown in FIG. 21(*a*), with the periphery of the first corner 21 and the periphery of the third corner 23 in the pouch 10 each being chucked with the chuck 410 of the filler 400, the pouch 10 is conveyed to the sealing line.

In the sixth step, as shown in FIG. 21(*b*), at a predetermined sealing line position, the sealing device 500 pinches the second opening 61. This seals the second opening 61.

In the seventh step, after sealing, as shown in FIG. 21(*c*), the sealing device 500 cancels the pinching of the second opening 61. After that, the sealing device 500 is separated from the content sealing pouch 2000.

Figure 22:
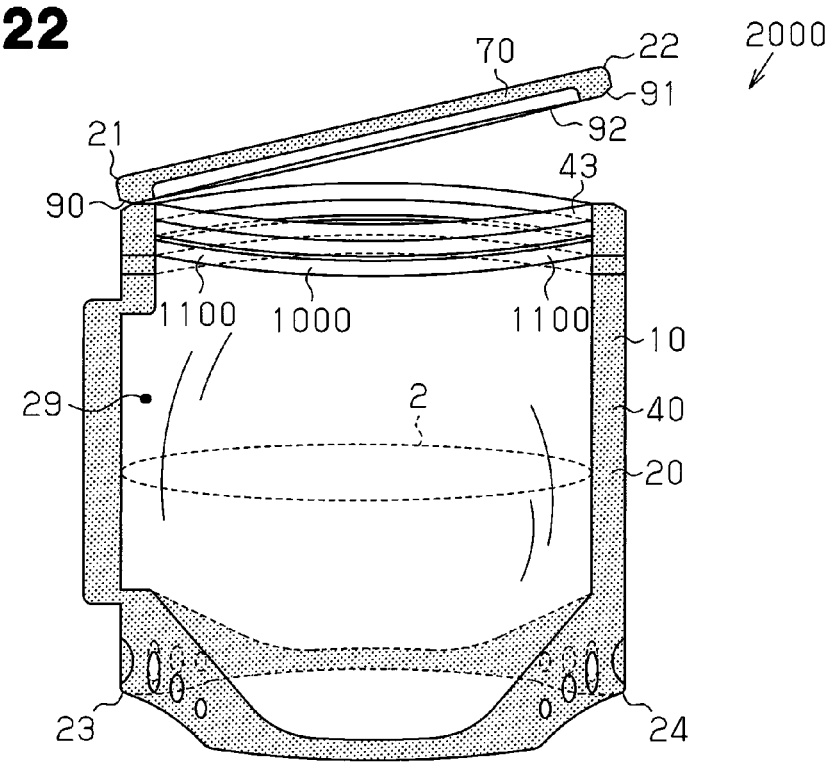
FIG. 22 is a front view of the content sealing pouch of FIG. 16 during cutting of a part of the bag.

With reference to FIGS. 22 though 25, a usage of the content sealing pouch 2000 will be described.

As shown in FIG. 22, by cutting the bag 20 along the guide line 92 using the notch 91 as a starting point, the bag 20 is divided into the primary bag portion 30 and the secondary bag portion 70 (hereinafter referred to as "divided state"). By canceling the engaged state of the high engaging-strength portion 1100 in the bag 20 in the divided state, the fastener 1000 is opened. This also opens the first opening 43. At this time, the easily-openable sealing portion 85 is also peeled.

Figure 23:
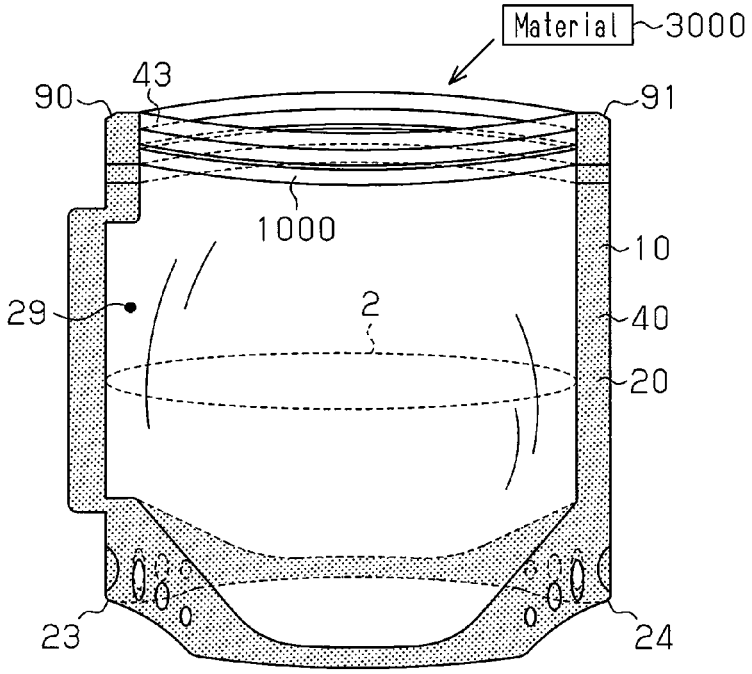
FIG. 23 is a front view of the content sealing pouch of FIG. 16 in a state where the first opening is opened.

As shown in FIG. 23, in the state where the first opening 43 is opened, the user injects food material 3000 into the internal space 29. The food material 3000 is selected as necessary from, for example, meat, vegetables, and so on by the user.

Figure 24:
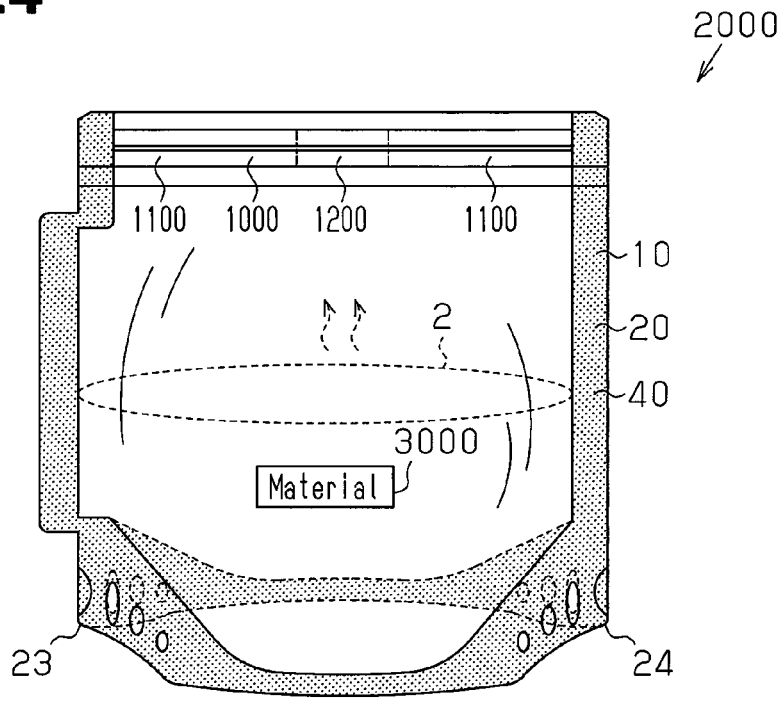
FIG. 24 is a front view of the content sealing pouch of FIG. 16.

As shown in FIG. 24, in the state where the content 2 and the food material 3000 are injected in the internal space 29, the fastener 1000 of the pouch 10 is closed again. After the fastener 1000 is closed again, the pouch 10 is heated in a microwave oven. Heating the content sealing pouch 2000 generates vapor in the internal space 29. For this reason, in the content sealing pouch 2000, the pressure of the internal space 29, that is, internal pressure rises. With the rise of the internal pressure of the content sealing pouch 2000, a force to separate opposed sheets forming the internal space 29 of the pouch 10 from each other acts on the content sealing pouch 2000. Further, with the rise of the internal pressure of the content sealing pouch 2000, a force to cancel the engaged state of the high engaging-strength portion 1100 (hereinafter referred to as "engagement canceling force") also acts on the content sealing pouch 2000.

By heating the content sealing pouch 2000 in the microwave oven, vapor generated in the internal space 29 is slightly discharged to the outside through the low engaging-strength portion 1200. However, the speed at which vapor is discharged to the outside through the low engaging-strength portion 1200 is much slower than the speed at which vapor is generated in the internal space 29. Accordingly, the pressure of the internal space 29 rises.

Figure 25:
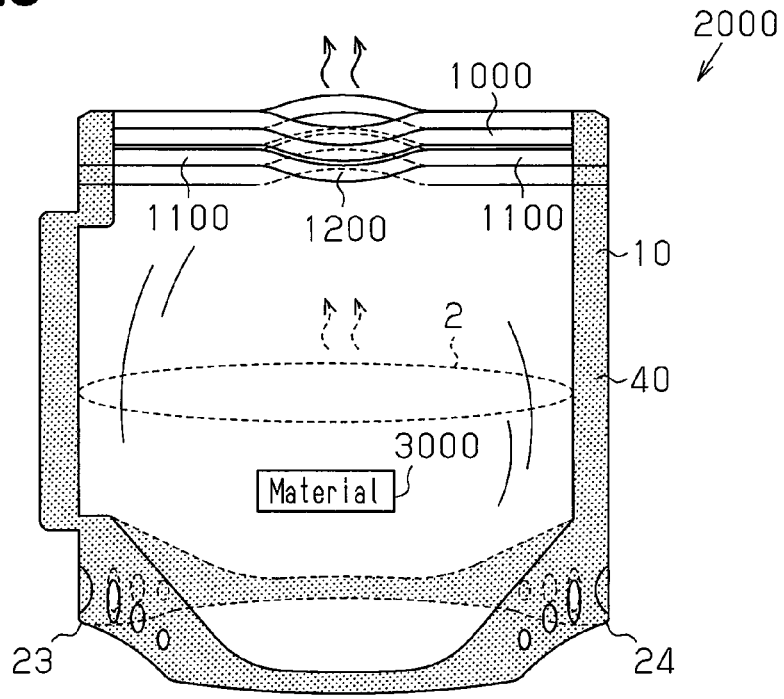
FIG. 25 is a front view of the content sealing pouch of FIG. 16 in a state where the low engaging-strength portion is opened.

As shown in FIG. 25, in the content sealing pouch 2000, before the engagement cancelling force exceeds the engaging strength of the high engaging-strength portion 1100, the low engaging-strength portion 1200 is opened. As a result, the speed at which vapor is discharged to the outside through the low engaging-strength portion 1200 becomes higher than the speed at which vapor is generated in the internal space 29. Thus, the rise of the internal pressure of the content sealing pouch 2000 is lessened and then, stopped. At unsealing of the low engaging-strength portion 1200, the engaged state of the high engaging-strength portion 1100 is partially cancelled.

With reference to FIG. 26, experiment results will be described that demonstrate opening conditions of the fastener 1000 when the ratio of the engaging strength of the low engaging-strength portion to the engaging strength of the high engaging-strength portion (hereinafter referred to as "strength ratio") is varied.

This experiment used a low engaging-strength portion formed at the center of a fastener having a length of 150 mm. A high engaging-strength portion in this experiment had an engaging strength of 38 N/20 mm. A high engaging-strength portion was a portion other than the low engaging-strength portion in the fastener. The low engaging-strength portion was formed by collapsing a central part of a fastener under a predetermined pressure, a predetermined time, and a predetermined temperature. The low engaging-strength portion had a low engaging-strength portion length of 20 mm.

For a strength ratio of 100%, that is, if the fastener had no low engaging-strength portion, the fastener opened with a large sound with a rise of internal pressure of the content sealing pouch due to heating.

For a strength ratio of 95%, the fastener opened with a large sound with a rise of internal pressure of the content sealing pouch due to heating.

Sound at opening of the fastener with the rise of the internal pressure of the content sealing pouch due to heating for strength ratios of 70%, 80%, and 90% was slightly smaller than sound for strength ratios of 95% and 100%.

Sound at opening of the fastener with the rise of the internal pressure of the content sealing pouch due to heating for strength ratios of 0%, 30%, and 50% was smaller than sound for strength ratios of 70%, 80%, 90%, 95%, and 100%.

The result demonstrates that strength ratios of 90% or less reduced the sound at opening of the fastener. Especially, strength ratios of 50% or less remarkably reduced the sound at opening of the fastener.

With reference to FIG. 27, experiment results will be described that demonstrate opening conditions of the fastener 1000 when the ratio of the length of the low engaging-strength portion to the length of the fastener (hereinafter referred to as "strength portion length ratio") was varied.

This experiment used a low engaging-strength portion formed at the center of a fastener having a length of 150 mm. A high engaging-strength portion was a portion other than the low engaging-strength portion in the fastener. The low engaging-strength portion was formed by collapsing a central part of a fastener under a predetermined pressure, a predetermined time, and a predetermined temperature. The low engaging-strength portion had an engaging strength of 0 N/20 mm.

When the strength portion length ratio was 0%, that is, the fastener had no low engaging-strength portion, the fastener opened with a large sound with a rise of internal pressure of the content sealing pouch due to heating.

Sound at opening of the fastener with the rise of the internal pressure of the content sealing pouch due to heating for a strength portion length ratio of 5% was slightly smaller than sound for a strength portion length ratio of 0%.

Sound at opening of the fastener with the rise of the internal pressure of the content sealing pouch due to heating for strength portion length ratios of 10%, 20%, and 50% was smaller than sound for strength portion length ratios of 0% and 5%.

Sound at opening of the fastener with the rise of the internal pressure of the content sealing pouch due to heating for a strength portion length ratio of 70% was smaller than sound for strength portion length ratios of 0%, 5%, 10%, 20%, and 50%. However, when the strength portion length ratio was 70%, the sealing performance of the fastener in the pouch degraded.

Sound at opening of the fastener with the rise of the internal pressure of the content sealing pouch due to heating for a strength portion length ratio of 80% was smaller than sound for strength portion length ratios of 0%, 5%, 10%, 20%, 50%, and 70%. However, the sealing performance of the fastener in the pouch when the strength portion length ratio was 80% was lower than that when the strength portion length ratio was 70%.

The results demonstrate that strength portion length ratios of 5% or more reduced the sound at opening of the fastener. Especially, the strength portion length ratios in the range of 5% to 70% suppressed the sealing performance of the fastener in the pouch from degrading and reduced the sound at opening of the fastener.

The pouch 10 of the sixth embodiment has the following advantages.

(10) The pouch 10 includes the fastener 1000. The fastener 1000 includes the high engaging-strength portion 1100 and the low engaging-strength portion 1200. Thus, when the content sealing pouch 2000 using the pouch 10 is heated, the engagement cancelling force, which rises with a rise in the internal pressure, reaches the engaging strength of the low engaging-strength portion 1200 earlier than the engaging strength of the high engaging-strength portion 1100. Accordingly, the engaged state of the low engaging-strength portion 1200 is cancelled earlier than the engaged state of the high engaging-strength portion 1100. Thus, before the engagement cancelling force reaches the engaging strength of the high engaging-strength portion 1100, vapor generated in the internal space 29 can be discharged to the outside. This can reduce the sound generated at unsealing of the pouch 10 with the rise of the internal pressure.

(11) The pouch 10 includes the second opening 61 in addition to the first opening 43. Thus, in the manufacturing process of the content sealing pouch 2000, the content 2 can be placed into the internal space 29 of the pouch 10 through the second opening 61. Accordingly, in the manufacturing process of the content sealing pouch 2000, the possibility that the contents adhere to the fastener 1000 is reduced.

(12) The pouch 10 includes the bag 20. The bag 20 includes the bag body 40, the bottom gusset 50, and the protruding portion 60. The protruding portion 60 has the second opening 61. The second opening 61 protrudes from the bag body 40 toward the outside of the bag 20. Thus, when the second opening 61 is sealed in the manufacturing process of the content sealing pouch 2000, the state where the chuck 410 that chucks the pouch 10 can be located outside the moving path of the sealing device 500. This facilitates sealing of the second opening 61.

(13) The pouch 10 includes the easily-openable sealing portion 85. The easily-openable sealing portion 85 closes the first opening 43. The easily-openable sealing portion 85 is formed between the fastener 1000 and the internal space 29.

Accordingly, when the content 2 is placed in the internal space 29 of the bag 20 through the second opening 61, the possibility that the content 2 adheres to the fastener 1000 is reduced.

Other Embodiments

The pouch and the content sealing pouch include embodiments other than the first through sixth embodiments. Modifications of the first to sixth embodiments as other embodiments of the pouch and the content sealing pouch will be described. The following modifications may be combined with each other as long as they do not technically conflict with each other.

The pouch 100 of the first embodiment includes the second opening 136 in the first lateral portion 131A. In contrast, a pouch of a modification includes the second opening 136 in the bottom gusset 132 in place of the first lateral portion 131A. In summary, the position of the second opening 136 of the first embodiment is only an example, and may be changed as long as the second opening 136 can perform its function.

The second opening 136 of the pouch 100 of the first embodiment is formed in the protruding portion extending from the first lateral portion 131A of the bag body 131. In contrast, a pouch of a modification has the second opening 136 in the first lateral portion 131A. That is, the pouch 100 of the modification includes no protruding portion having the second opening 136.

The cutting portion 163 of the first embodiment includes the intermediate cutting portion 164, the first predetermined cutting portion 165, the second predetermined cutting portion 166, and the separating portion 167. In contrast, a cutting portion 163 of a modification includes only the intermediate cutting portion 164 among the intermediate cutting portion 164, the first predetermined cutting portion 165, the second predetermined cutting portion 166, and the separating portion 167. In summary, the configuration of the cutting portion 163 in the first embodiment is only an example, and may be changed as long as it can assist cutting of the fastener 170.

The cutting restraining portion 138 of the first embodiment has the configuration in which the end of the second predetermined cutting portion 166 near the internal space 119 is curved opposite to the internal space 119. In contrast, a cutting restraining portion 138 of a modification has a high-strength sealing portion, in which the sealing strength of the end of the second predetermined cutting portion 166 near the internal space 119 is locally increased.

The vapor passage portion 140 of the first embodiment has unsealed vapor passage 141. In contrast, a vapor passage portion 140 of a modification includes the weakly-sealed vapor passage 141. The sealing strength of the weakly-sealing portion is lower than the sealing strength of the sealing portion 120.

The opening guide line 161 and the vapor passage guide line 162 of the first embodiment are formed by half-cutting the film constituting the bag 110 with a laser. In contrast, at least one of an opening guide line and a vapor passage guide line of a modification is formed by perforating a film forming the bag 110.

The pouch 100 of the first embodiment includes the sealing portion 120 sealed by thermal welding. In contrast, a pouch 100 of a modification includes the sealing portion 120 sealed by at least one of impulse sealing, high-frequency sealing, and ultrasonic sealing.

The content sealing pouch 1 of the first embodiment accommodates liquid condiment as the content 2 in the internal space 119. In contrast, a content sealing pouch 1 of a modification accommodates medical equipment or a feeding bottle as the content 2.

The pouch 700 of the fourth embodiment includes the easily-openable sealing portion 900. The easily-openable sealing portion 900 includes the bag sealing portion 920. The bag sealing portion 920 is sealed to the inner circumferential surface of the bag 210. In contrast, an easily-openable sealing portion of a modification can be easily peeled because opposed inner circumferential surfaces of the bag 210 are sealed to each other.

The pouch 950 of the fifth embodiment includes no fastener 270. In contrast, a pouch of a modification includes the fastener 270. The pouch of the modification includes the fastener 270 between the vapor passage portion 951 and the guide line 260. Accordingly, after materials are added into the internal space 219, the first opening 235 can be closed again.

The fastener 1000 of the sixth embodiment includes one low engaging-strength portion 1200. In contrast, a fastener of a modification includes a plurality of low engaging-strength portions 1200.

The low engaging-strength portion length LD of the fastener 1000 of the sixth embodiment is 20% of the fastener length LA. In contrast, a low engaging-strength portion length LD of a modification is appropriately selected from a range of 5% to 70% of the fastener length LA.

The first high engaging-strength portion length LB and the second high engaging-strength portion length LC of the sixth embodiment are equal to each other. In contrast, a first high engaging-strength portion length of a modification is different from the second high engaging-strength portion length. In summary, the first high engaging-strength portion length and the second high engaging-strength portion length may be appropriately changed.

The engaging strength of the low engaging-strength portion 1200 of the sixth embodiment is 0% of the engaging strength of the high engaging-strength portion 1100. In contrast, the engaging strength of a low engaging-strength portion of a modification is appropriately selected from a range of 0% to 90% of the engaging strength of the high engaging-strength portion 1100.

The low engaging-strength portion 1200 of the sixth embodiment is formed by collapsing the fastener 1000 having the same configuration as the high engaging-strength portion 1100 under a predetermined pressure, a predetermined time, and a predetermined temperature. In contrast, a low engaging-strength portion of a modification is formed by separately inserting a fastener having a lower engaging strength than the high engaging-strength portion 1100.

The low engaging-strength portion 1200 of the sixth embodiment includes the deformable female track 1220. The deformable female track 1220 includes the unsealing-side deformable claw 1230 and the content-side deformable claw 1240. In contrast, a deformable female track of a modification does not include at least one of the unsealing-side deformable claw 1230 and the content-side deformable claw 1240.

The low engaging-strength portion 1200 of the sixth embodiment has the deformable male base 1260. The deformable male base 1260 includes the unsealing-side deformable claw 1280A and the contents-side deformable claw 1280B. In contrast, a deformable male track of a modification does not include at least one of the unsealing-side deformable claw 1280A and the contents-side deformable claw 1280B.

The pouch 10 of the sixth embodiment includes the upper sealing portion 83, the easily-openable sealing portion 85, the protruding portion 60, and the second opening 61. In contrast, a pouch of a modification does not include at least one of the upper sealing portion 83, the easily-openable sealing portion 85, the protruding portion 60, and the second opening 61.

The pouch 10 of the sixth embodiment has a form of a standing pouch. In contrast, a pouch of a modification may take various forms such as flat type.

The content sealing pouch 2000 of the sixth embodiment includes the contents 2. The contents 2 are liquid condiment. In contrast, contents 2 of the content sealing pouch of a modification are sterilized materials such as medical equipment and feeding bottle.

Embodiments of the present invention have the following aspects.

Supplementary Means 1

A pouch comprising:

a bag that has an internal space for accommodating a content and an opening and is adapted to place the content in the internal space through the opening; and a fastener for opening and closing the opening, wherein the bag includes an opening sealing portion formed at the edge of the opening to close the opening, an opening guide line for separating the opening sealing portion from the opening, a vapor passage portion for removing vapor from the internal space, a vapor passage sealing portion for closing the vapor passage portion, a vapor passage guide line for separating the vapor passage sealing portion from the vapor passage portion, and a cutting portion for cutting at least the fastener, the opening sealing portion can be separated from the opening along the opening guide line, the vapor passage sealing portion can be separated from the vapor passage portion along the vapor passage guide line, the opening is formed to be continuous with the vapor passage portion, the opening sealing portion is formed to be continuous with the vapor passage sealing portion, the fastener is formed to bridge the opening and the vapor passage sealing portion and includes an opening fastener portion located on the opening and a vapor passage fastener portion located on the vapor passage sealing portion, and the cutting portion is formed at a position corresponding to an end of the vapor passage guide line.

The cutting portion of the pouch corresponds to an end of the vapor passage guide line. Thus, by separating the vapor passage sealing portion from the vapor passage portion along the vapor passage guide line, the vapor passage fastener portion is separated from the opening fastener portion. As a result, the operation of separating the vapor passage sealing portion from the vapor passage portion and the operation of separating the vapor passage fastener portion from the opening fastener portion are combined into one consecutive operation.

Supplementary Means 2

The pouch according to the supplementary means 1, wherein the bag includes a bag predetermined portion located closer to the internal space than the fastener, and the cutting portion includes an intermediate cutting portion for cutting the fastener, a first predetermined cutting portion continuous with the intermediate cutting portion to cut the bag predetermined portion, a second predetermined cutting portion located at an end of the first predetermined cutting portion close to the internal space, and a separating portion for separating the first predetermined cutting portion from the second predetermined cutting portion.

The cutting portion of the bag, which includes the first predetermined cutting portion and the second predetermined cutting portion, enables easier separation of the bag predetermined portion from a remaining part of the bag than the configuration having no first predetermined cutting portion and no second predetermined cutting portion. Due to the presence of the first predetermined cutting portion and the second predetermined cutting portion, when a force to separate the section on the extension of the intermediate cutting portion in the bag acts on the bag, a region of the bag predetermined portion that is closer to the internal space than an end of the second predetermined cutting portion is possibly cut in order from the second predetermined cutting portion. When the cutting in order from the second predetermined cutting portion reaches the internal space, the internal space cannot be sealed. According to the above-mentioned invention, in consideration of such prediction, the separating portion is formed between the first predetermined cutting portion and the second predetermined cutting portion. Thus, when the force to separate the section on the extension of the intermediate cutting portion in the bag acts on the bag, this force acts as a force to cut the separating portion. Therefore, the possibility is reduced that the region of the bag predetermined portion that is closer to the internal space than the end of the second predetermined cutting portion is cut in order from the second predetermined cutting portion.

Supplementary Means 3

The pouch according to the supplementary means 1 or 2, wherein the bag includes, an extension of the cutting portion, a cutting restraining portion and a sealing portion having at least the opening sealing portion and the vapor passage sealing portion, and the cutting restraining portion functions to prevent cutting of the sealing portion along the extension of the cutting portion from reaching the internal space.

Since the bag has the cutting restraining portion, when the force to separate the section on the extension of the intermediate cutting portion in the bag acts on the bag, the sealing portion of the bag is suppressed from being cut up to the internal space by this force.

What is claimed is:

1. A container comprising:

a bag body including an internal space to accommodate a content;

an opening formed in the bag body and communicating the internal space to an outside of the container; and a fastener to open and close the opening, wherein the fastener includes a high engaging-strength portion and a low engaging-strength portion, the engaging strength of the low engaging-strength portion is less than the engaging strength of the high engaging-strength portion, the high engaging-strength portion includes a female track and a male track that are configured to engage with each other to close the opening, the low engaging-strength portion includes a collapsed female track and a collapsed male track, the collapsed male track includes a male track base on the bag body and a deformed male base that protrudes from the male track base toward the collapsed female track, the collapsed female track includes a female track base on the bag body and a deformed female base that protrudes from the female track base toward the collapsed male track, and the collapsed female track and the collapsed male track are configured to close the opening by contacting each other and to open the opening by being separated from each other when a pressure of the internal space rises due to vapor generated from the content accommodated in the internal space.

2. A content sealing container comprising:

the container according to claim 1; and a content accommodated in the internal space,
wherein the opening is sealed.

3. A container comprising:

a bag body including an internal space to accommodate a content;

an opening formed in the bag body and communicating the internal space to an outside of the container; and a fastener to open and close the opening, wherein the fastener includes a high engaging-strength portion and a low engaging-strength portion, the engaging strength of the low engaging-strength portion is less than the engaging strength of the high engaging-strength portion, the high engaging-strength portion includes a female track and a male track that are configured to engage with each other to close the opening, the low engaging-strength portion includes a female track and a collapsed male track, the collapsed male track includes a male track base on the bag body and a deformed male base that protrudes from the male track base toward the female track of the low engaging-strength portion, and the female track of the low engaging-strength portion and the collapsed male track are configured to close the opening by contacting each other and to open the opening by being separated from each other when a pressure of the internal space rises due to vapor generated from the content accommodated in the internal space.

4. A content sealing container comprising:

the container according to claim 3; and a content accommodated in the internal space, wherein the opening is sealed.

5. A container comprising:

a bag body including an internal space to accommodate a content;

an opening formed in the bag body and communicating the internal space to an outside of the container; and a fastener to open and close the opening, wherein the fastener includes a high engaging-strength portion and a low engaging-strength portion, the engaging strength of the low engaging-strength portion is less than the engaging strength of the high engaging-strength portion, the high engaging-strength portion includes a female track and a male track that are configured to engage with each other to close the opening, the low engaging-strength portion includes a collapsed female track and a male track, the collapsed female track includes a female track base on the bag body and a deformed female base that protrudes from the female track base toward the male track of the low engaging-strength portion, and the collapsed female track and the male track of the low engaging-strength portion are configured to close the opening by contacting each other and to open the opening by being separated from each other when a pressure of the internal space rises due to vapor generated from the content accommodated in the internal space.

6. A content sealing container comprising:

the container according to claim 5; and a content accommodated in the internal space, wherein the opening is sealed.

* * * * *